US008360243B2

(12) United States Patent
Yamada et al.

(10) Patent No.: US 8,360,243 B2
(45) Date of Patent: Jan. 29, 2013

(54) LIQUID TRANSPORTING APPARATUS, CLASSIFYING APPARATUS, AND CLASSIFYING METHOD

(75) Inventors: Takayuki Yamada, Kanagawa (JP); Hiroshi Kojima, Kanagawa (JP); Kazuaki Tabata, Kanagawa (JP); Masaki Hirota, Kanagawa (JP); Kazuya Hongo, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 491 days.

(21) Appl. No.: 12/730,830

(22) Filed: Mar. 24, 2010

(65) Prior Publication Data

US 2011/0073530 A1 Mar. 31, 2011

(30) Foreign Application Priority Data

Sep. 28, 2009 (JP) ..... 2009-222182

(51) Int. Cl.
*B07B 9/00* (2006.01)

(52) U.S. Cl. ..... 209/17; 209/208

(58) Field of Classification Search ..... 209/17, 209/208

See application file for complete search history.

(56) References Cited

U.S. PATENT DOCUMENTS 7,285,144 B2 * 10/2007 Nagato et al. ..... 48/198.6
2005/0249034 A1 * 11/2005 Takagi et al. ..... 366/341
2006/0070921 A1 * 4/2006 Takagi et al. ..... 209/208
2008/0008911 A1 * 1/2008 Stroock et al. ..... 429/13
2010/0237518 A1 * 9/2010 Bachmann ..... 261/97

FOREIGN PATENT DOCUMENTS

JP A 2004-330008 11/2004
JP A 2005-319409 11/2005
JP A 2006-116520 5/2006
JP A 2006-187684 7/2006

OTHER PUBLICATIONS

A. Stroock et al., "Chaotic Mixer for Microchannels," Science, vol. 295, Jan. 25, 2002, pp. 647-651.

* cited by examiner

*Primary Examiner* — Terrell Matthews
(74) *Attorney, Agent, or Firm* — Oliff & Berridge, PLC

(57) ABSTRACT

A liquid transporting apparatus includes: a microchannel; a transporting liquid supply port through which transporting liquid is supplied to the microchannel; a partition wall as defined herein, and that has an opening; a first split channel that is provided on an upper side of the partition wall; a second split channel that is provided on a lower side of the partition wall; a particle dispersion supply port through which a particle dispersion is supplied to a middle portion of a width direction of the first split channel; and at least one drain port through which the fluid is discharged from downstreams of the first and second split channels, and a pattern that generates an upward-directed flow with respect to a vertical direction in a middle portion of a section of the microchannel is formed in an inner wall of the microchannel or in the partition wall.

24 Claims, 16 Drawing Sheets

EXCHANGE FLOW

UPWARD FLOW

LIQUID TRANSPORTING APPARATUS, CLASSIFYING APPARATUS, AND CLASSIFYING METHOD

CROSS-REFERENCE TO RELATED APPLICATIONS

This application is based on and claims priority under 35 USC 119 from Japanese Patent Application No. 2009-222182 filed on Sep. 28, 2009.

BACKGROUND

1. Technical Field

The present invention relates to a liquid transporting apparatus, a classifying apparatus, and a classifying method.

2. Related Art

Recently, a unit operation in chemical engineering using a microchannel device attracts attention. In the case where a microchannel is used, fluid is formed as a laminar flow, and not disturbed. As a usual method of avoiding deposition of particles and clogging of a channel, therefore, there is a method in which a density of a dispersion medium is set equal to that of the particles. When the method is employed, particles may not be sedimented, and hence it may be possible to prevent deposition and clogging from occurring.

SUMMARY

According to an aspect of the invention, there is provided a liquid transporting apparatus including: a microchannel; a transporting liquid supply port through which transporting liquid is supplied to the microchannel; a partition wall which is formed in a flowing direction of a fluid in the microchannel to vertically split the microchannel, and which has an opening; a first split channel which is located on an upper side of the partition wall; a second split channel which is located on a lower side of the partition wall; a particle dispersion supply port through which a particle dispersion is supplied to a middle portion of a width direction of the first split channel; and at least one drain port through which the fluid is discharged from downstreams of the first and second split channels, wherein a pattern which generates an upward-directed flow with respect to the vertical direction in a middle portion of a section of the microchannel is formed in an inner wall of the microchannel or in the partition wall.

BRIEF DESCRIPTION OF THE DRAWINGS

Exemplary embodiments of the present invention will be described in detail based on the following figures, wherein.

DESCRIPTION OF REFERENCE NUMERALS AND SIGNS

Figure 1:
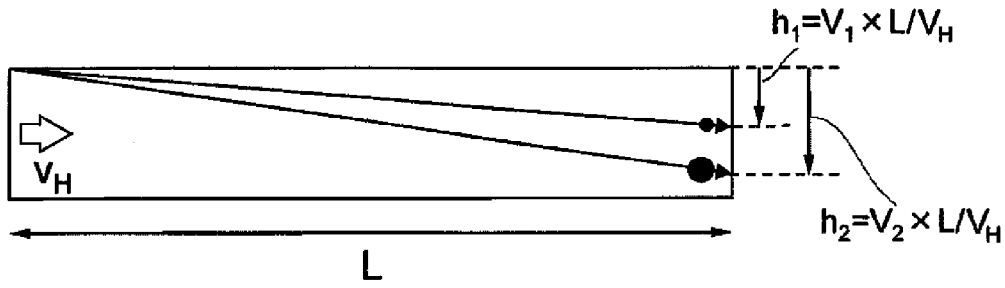
FIG. 1 is a diagram showing a manner of sedimentation of particles having different particle sizes.

B transporting liquid
C upward flow
1 microchannel
2 first split channel
3 second split channel
4 partition wall
5 pattern
6 transporting liquid supply port
7 particle dispersion supply port
8 drain port
10 liquid transporting apparatus
500 metal substrate (first substrate)
501A first pattern member
501B second pattern member
505 donor substrate
510 target substrate

DETAILED DESCRIPTION

A liquid transporting apparatus of the exemplary embodiment is characterized in that the apparatus has: a microchannel; a transporting liquid supply port through which transporting liquid is supplied to the microchannel; a partition wall which is formed in a flowing direction of a fluid in the microchannel to vertically split the microchannel, and which has an opening; a first split channel which is located on the upper side of the partition wall; a second split channel which is located on the lower side of the partition wall; a particle dispersion supply port through which a particle dispersion is supplied to a middle portion of the width direction of the first split channel; and at least one drain port through which the fluid is discharged from the downstreams of the first and second split channels, and is characterized in that a pattern which generates an upward-directed flow with respect to the vertical direction in a middle portion of a section of the microchannel is formed in an inner wall of the microchannel or in the partition wall.

In the exemplary embodiment, in the particle dispersion containing particles, the specific gravity of the particles is larger than that of the dispersion medium of the particle dispersion, and the particles are sedimented in the particle dispersion. Hereinafter, the liquid transporting apparatus of the exemplary embodiment will be described in detail with reference to the drawings. In the following description, unless otherwise specified, the same reference numerals denote identical components. In the following description, unless otherwise specified, furthermore, the terms "A to B" indicating a numerical range mean "equal to or larger than A and equal to or smaller than B". The terms mean a numerical range including A and B which are the end points.

The terminal velocity (the velocity when the gravitational force balances with the resistance force) of particles which are being sedimented in a fluid is expressed by following Stokes equation.

$$v_s = \frac{D_p^2(\rho_p - \rho_f)g}{18\eta}$$

($V_s$: terminal velocity of particles, $D_p$: particle diameter, $\rho_p$: density of particles, $\rho_f$: density of fluid, g: acceleration of gravity, $\eta$: viscosity of fluid)

As shown in FIG. 1, when particles are sedimented while the fluid is flown at a velocity of $V_H$ in the horizontal direction, particles of different sizes are separated in the vertical direction by distances of $h_1$ and $h_2$ correspond to terminal velocities of $V_1$ and $V_2$. However, a secondary flow (exchange flow) is generated in accordance with the sedimentation of particles. This functions as a disturbance to the classification which depends on Stokes equation above, so that the accuracy of classification is lowered and the classification efficiency is reduced.

When particles are sedimented by gravitational force, fluid is moved in order to fill the volume where the particles have existed. The movement of fluid due to such sedimentation of particles is called a exchange flow. In the case where the particle density is sufficiently low, fluid is moved through gaps between particles, and hence the movement exerts substantially no influence. By contrast, in the case where the particle density is high, the distance between particles is short, and hence fluid cannot be easily moved between particles as compared with the case where the particle density is sufficiently low, so that particles are sedimented in a state where the particles are closely packed at a certain extent, and hence a exchange flow is generated. As a result, it is seemed that sedimentation of particles occurs at a flow velocity which is equal to or higher than the terminal sedimentation velocity that is calculated by Stokes equation.

In the cases where particles separate from the sidewall, and where particles exist also in the vicinity of the sidewall, a exchange flow influences the particles in different manners.

Figure 2A:
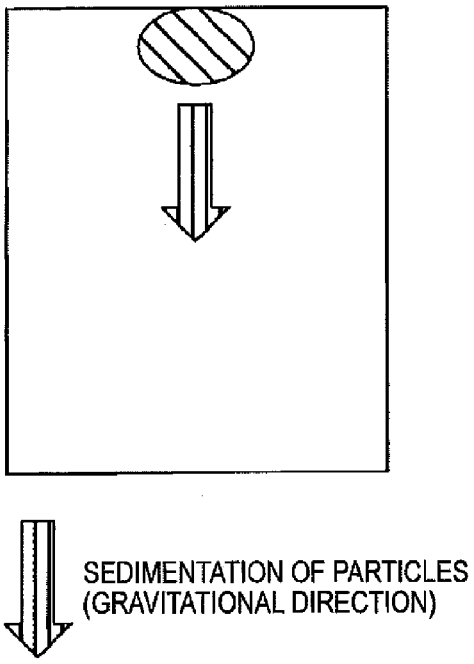
FIGS. 2A and 2B are diagrams showing an example of the behavior of particles.
Figure 2B:
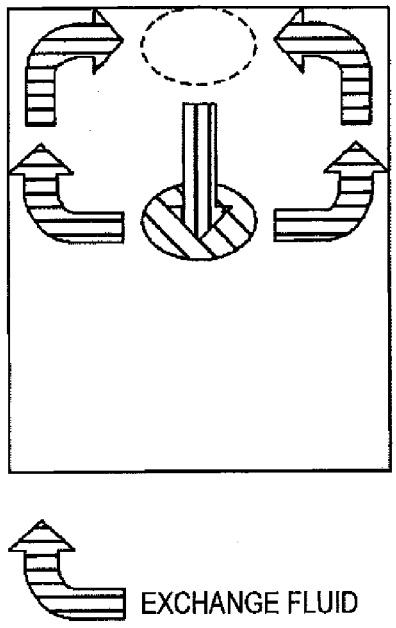

In the case where particles separate from the sidewall and exist in a middle portion of the channel width as shown in FIG. 2A, when the particles are downwardly sedimented, the fluid flows from the lateral side of the particles so as to fill the volume where the particles have existed, as shown in FIG. 2B. In the vicinity of the middle, a exchange flow is generated in the sedimentation direction, and, in the vicinity of the sidewall, a exchange flow is generated in the direction opposite to the sedimentation direction, whereby a vortex is formed. Namely, the exchange flow flows downwardly in the middle of the channel, and upwardly in the vicinity of the sidewall. As a result, a downward force due to the exchange flow is applied to the particles. In Stokes equation, the terminal velocity is determined by a balance between the gravitational force which downwardly acts on the particles, and the resistance force and buoyancy which apply upward force. However, the exchange flow downwardly affects the particles. Therefore, it is observed that the particles are sedimented at a velocity which is higher than the terminal velocity.

Figure 3A:
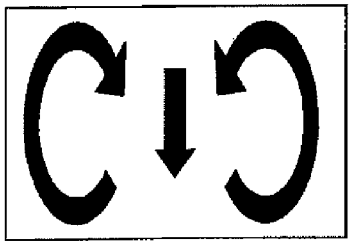
FIGS. 3A and 3B are diagrams showing a exchange flow and an upward flow.
Figure 3B:
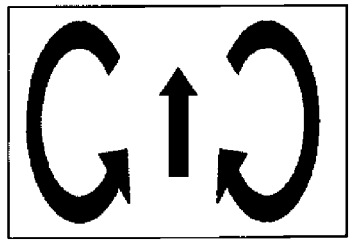

The liquid transporting apparatus of the exemplary embodiment has an opening or a groove for suppressing a exchange flow, in the partition wall or the inner wall of the microchannel, and generates a vortex in a direction along which the exchange flow is canceled. For the exchange flow such as shown in FIGS. 2B and 3A, namely, a flow which is opposite in direction to the exchange flow as shown in FIG. 3B is generated, whereby the exchange flow is canceled. Therefore, the exchange flow is reduced, and a stabilized sedimentation velocity can be obtained.

Furthermore, the liquid transporting apparatus of the exemplary embodiment has a double bottom structure, so that coarse powder which may cause clogging drops to the lowermost channel. In the upper channel, therefore, clogging hardly occurs, and the flow is not disturbed by unwanted coarse powder. The plural takeout ports (drain ports) are disposed in the outlet of the channel in which the exchange flow is suppressed, and particles corresponding to the particle size difference are taken out, whereby it is possible to provide a classifying apparatus in which the classification accuracy and efficiency are improved.

(First Exemplary Embodiment)

The liquid transporting apparatus of the exemplary embodiment will be described by exemplifying a liquid transporting apparatus of a first exemplary embodiment.

The liquid transporting apparatus of the first exemplary embodiment is characterized in that the apparatus has: a microchannel; a transporting liquid supply port through which transporting liquid is supplied to the microchannel; a partition wall which is formed in a flowing direction of a fluid in the microchannel to vertically split the microchannel, and which has an opening; a first split channel which is located on the upper side of the partition wall; a second split channel which is located on the lower side of the partition wall; a particle dispersion supply port through which a particle dispersion is supplied to a middle portion of the width direction of the first split channel; and at least one drain port through which the fluid is discharged from the downstreams of the first and second split channels, and characterized in that a pattern which generates an upward-directed flow with respect to the vertical direction in a middle portion of a section of the microchannel is formed in an inner wall of the microchannel or in the partition wall, and the pattern is a pattern which is formed in the partition wall, and an opening pattern in which a plurality of V-like opening portions that are directed from the sidewalls of the microchannel toward the middle of the microchannel are continued along the flowing direction of the fluid.

Figure 4:
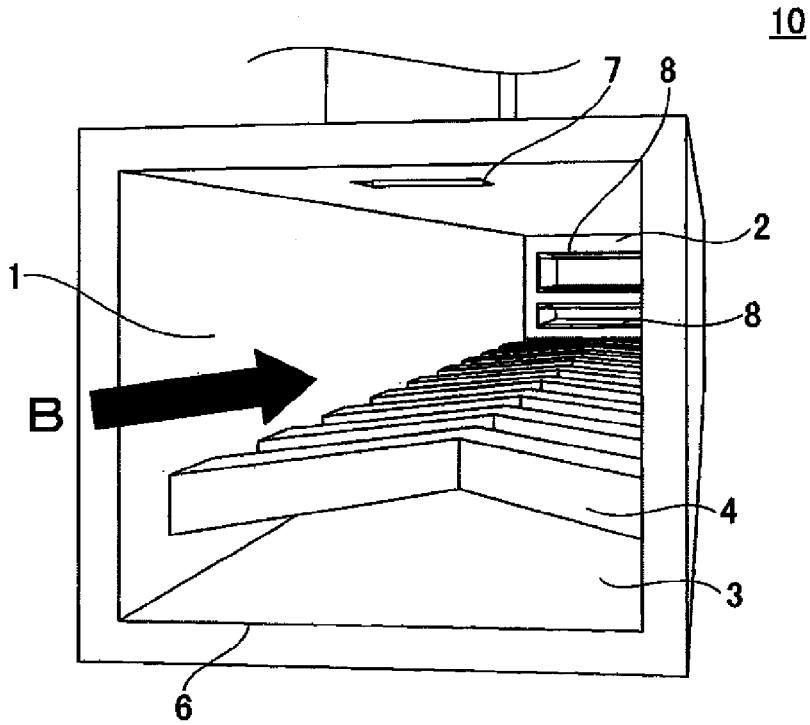
FIG. 4 is a perspective view of a liquid transporting apparatus of a first exemplary embodiment.

FIG. 4 is a perspective view of the liquid transporting apparatus of the first exemplary embodiment.

A partition wall 4 having V-like openings partitions between a first split channel 2 and a second split channel 3.

Transporting liquid B is transported into the whole of a microchannel 1, but introduced mainly from the first split channel 2 as indicated by the arrow.

Figure 5:
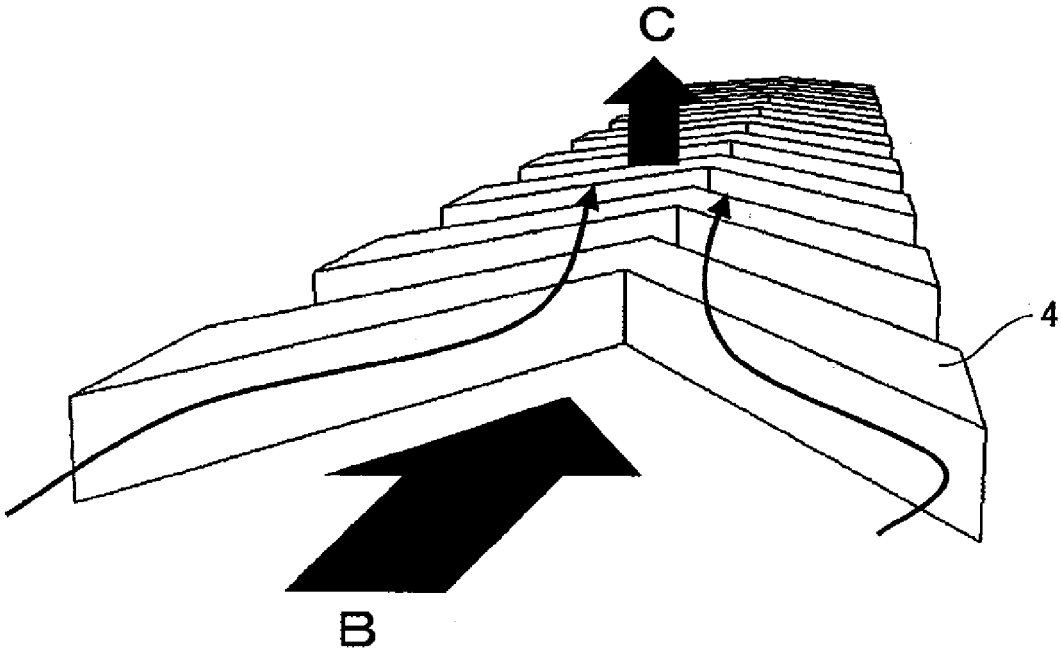
FIG. 5 is a conceptual diagram showing generation of an upward flow in the first exemplary embodiment.

FIG. 5 is a conceptual diagram showing generation of an upward flow. Among the transporting liquid B introduced into the first split channel 2, the transporting liquid B in the vicinity of the partition wall 4 collides with the side face of the V-like partition wall as indicated by the curved arrows in FIG. 5, and the direction of the liquid is changed from the sidewall side of the microchannel toward the inner side because of the inclination of the partition wall. As a result, the fluid which collects to the middle portion from the both sidewall sides has nowhere to go, and causes an upward flow C in the middle portion of the first split channel 2.

Figure 6:
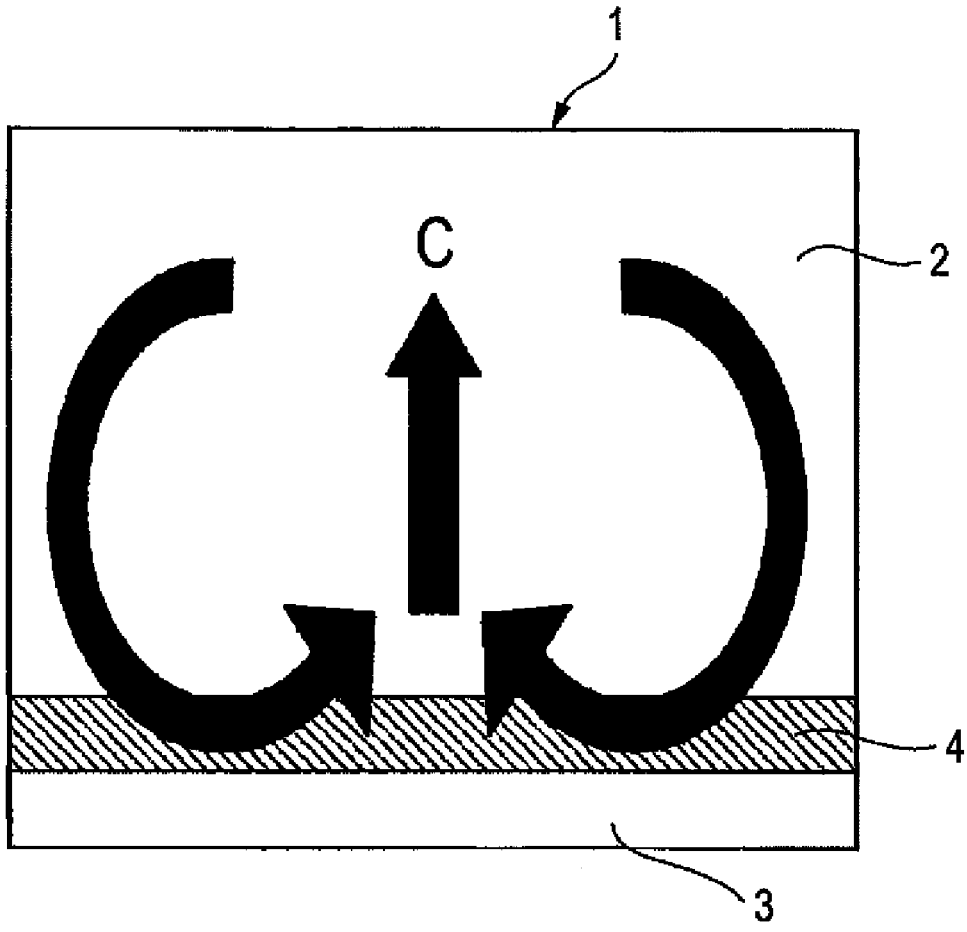
FIG. 6 is a diagram of the upward flow in the first exemplary embodiment.

As shown in FIG. 6, the upward flow C collides with a ceiling portion of the microchannel 1 to laterally split, and then is formed into downward flows in the vicinities of the sidewalls of the microchannel 1. The upward and downward flows are directed in the direction entirely opposite to that of the exchange flow which occurs in the case where particles are supplied into the vicinity of the middle portion of the microchannel. When the liquid transporting conditions such as the structure and the flow velocity are adequately designed, therefore, the exchange flow and the upward flow can offset each other.

(Microchannel)

The liquid transporting apparatus of the exemplary embodiment has a microchannel (hereinafter, referred to also as "channel").

In the exemplary embodiment, preferably, the microchannel is a microchannel. In a microchannel, both the dimensions and the flow velocity are small.

In the exemplary embodiment, preferably, the Reynolds number in the microchannel is 2,300 or less. In the liquid transporting apparatus of the exemplary embodiment, namely, it is preferred that a turbulent flow is not predominant as in usual liquid transportation, but a laminar flow is predominant.

The Reynolds number (Re) is indicated by the following expression:

Re=uL/v (u: flow rate, L: characteristic length, and v: kinematic viscosity coefficient). When the number is 2,300 or less, a laminar flow is predominant.

In the exemplary embodiment, preferably, the Reynolds number is 500 or less, more preferably, 100 or less, and, still more preferably, 10 or less. When the Reynolds number is 500 or less, the sedimentation velocity of particles can be easily controlled, and hence this range is preferred.

In the case where a laminar flow is predominant, when particles in particle dispersion are heavier than a medium liquid which is a dispersion medium, the particles are sedimented in the medium liquid. The sedimentation velocity is varied depending on the specific gravity or size of the particles. In the exemplary embodiment, the difference in sedimentation velocity may be used for the classification of the particles. In the case where the particles have different particle sizes, particularly, the sedimentation velocity is proportional to a square value of the particle size, and, as the size of particles is larger, the particles are faster sedimented. Therefore, the exemplary embodiment is suitable for classifying particles of different particle sizes.

By contrast, in the case where the micochannel has a large diameter and the particle dispersion forms a turbulent flow, the position where particles are sedimented is varied. In the case, therefore, classification is basically impossible. In the case where also the transporting liquid is transported simultaneously with the particle dispersion, preferably, both the particle dispersion and the transporting liquid are transported under a laminar flow in the liquid transporting channel.

Preferably, the section shape of the microchannel in the case where the section is obtained by cutting the microchannel perpendicularly to the flowing direction of the fluid is a rectangle including a square shape and a rectangular shape.

Preferably, the shape of the microchannel in the liquid transportation direction is a straight linear shape, and does not include a curved or bent portion.

Figure 7A:
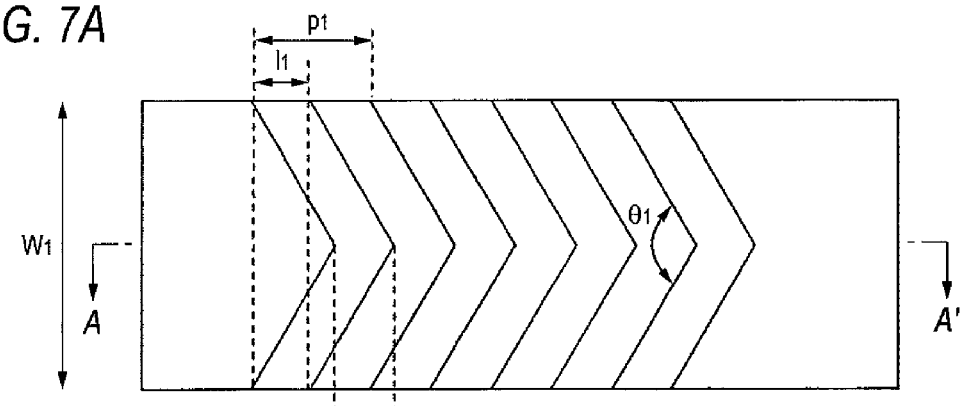
FIGS. 7A and 7B are diagrams illustrating shapes and the like of portions of the liquid transporting apparatus of the first exemplary embodiment.
Figure 7B:
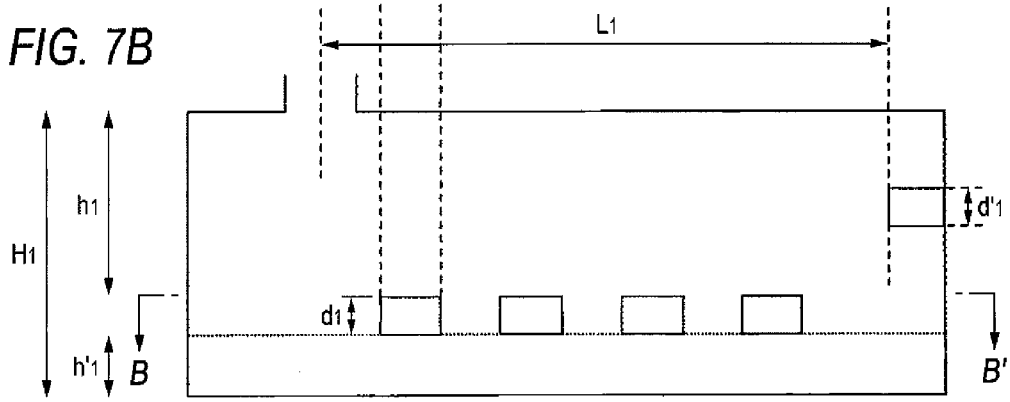

Preferred shapes and the like of the portions in the liquid transporting apparatus of the first exemplary embodiment will be described with reference to FIGS. 7A and 7B. FIGS. 7A and 7B are diagrams illustrating shapes and the like of the portions of the liquid transporting apparatus of the first exemplary embodiment, FIG. 7A is a plan view of the microchannel and the partition wall as viewed from the upper side, and FIG. 7B is a section view of the microchannel taken along A-A'.

Preferably, the width $W_1$ of the microchannel is 0.01 to 30 mm, more preferably, 0.1 to 10 mm, and, still more preferably, 0.2 to 1 mm. When the width is within the above numerical range, a laminar flow is easily formed, and sedimentation of particles is easily controlled. Therefore, the range is preferred.

The height of the microchannel is determined by the total of the height $h_1$ of the first split channel, the thickness $d_1$ of the partition wall, and the height $h_1'$ of the second split channel. Preferred ranges of the values will be described later.

Preferably, the channel length $L_1$ extending from the particle dispersion supply port to the drain port is 5 to 200 mm, more preferably, 10 to 100 mm, and, still more preferably, 20 to 30 mm. When the length is within the above numerical range, a high classification efficiency is obtained, and hence the range is preferred.

(Transporting Liquid Supply Port)

The liquid transporting apparatus of the exemplary embodiment has the transporting liquid supply port through which the transporting liquid is supplied to the microchannel.

The transporting liquid supply port is used for supplying the transporting liquid to the microchannel, and requested to supply the transporting liquid, at least to the first split channel. However, the port preferably supplies the transporting liquid to the whole microchannel. In the first exemplary embodiment, particularly, the transporting liquid collides with the side face of the partition wall to generate an upward flow. Therefore, the port preferably supplies the transporting liquid to the whole microchannel to cause the transporting liquid to collide with the side face of the partition wall. A washing liquid supply port for washing only the second split channel in the case where coarse powder accumulated in the second split channel causes clogging of the channel may be disposed in the second split channel. The transporting liquid is a liquid which does not contain particles to be classified. Preferably, the medium liquid for the particle dispersion which will be described later is identical with the transporting liquid.

(Partition Wall)

The liquid transporting apparatus of the exemplary embodiment has the partition wall which is formed in the fluid flowing direction in the microchannel to vertically split the microchannel, and which has an opening. The terms "vertically split the microchannel" means that the microchannel is vertically split in the vertical direction. The partition wall is formed in the fluid flowing direction in the microchannel, and specifically it is preferred to the upper face of the microchannel and that of the partition wall are formed to be parallel with each other.

The opening is formed in the partition wall. In the configuration where the opening is formed in the partition wall, coarse powder which is contained in the particle dispersion, and in which the sedimentation velocity is high is allowed to pass through the opening, and the coarse powder can be separated into the second split channel. Therefore, clogging of the whole microchannel can be prevented from occurring.

Preferably, the ratio $d_1/h_1$ of the thickness $d_1$ of the partition wall shown in FIG. 7B to the height $h_1$ of the first split channel is 0.1 to 0.5, and, more preferably, 0.2 to 0.3. When the ratio is within the above numerical range, an upward flow can be efficiently produced. Therefore, the range is preferred.

In the first exemplary embodiment, as shown in FIGS. 4 to 6, the opening which is formed in the partition wall is configured as a pattern for generating an upward flow.

(Split Channel)

The liquid transporting apparatus of the exemplary embodiment has the first split channel which is located on the upper side of the partition wall, and the second split channel which is located on the lower side of the partition wall. Referring to FIGS. 7A and 7B, preferred dimensions of the split channels will be described.

The widths of the first and second split channels are equal to the width $W_1$ of the microchannel, and the preferred range of the widths is identical with that of the width of the microchannel.

Preferably, the ratio $h_1/W_1$ of the height $h_1$ of the first split channel to the width of the microchannel is 0.1 to 10, and, more preferably, 0.5 to 2.0. When the ratio is within the above numerical range, a sufficient sedimentation length can be ensured. Therefore, the range is preferred.

Preferably, the ratio $h_1'/d_1$ of the height $h_1'$ of the second split channel to the thickness $d_1$ of the partition wall is 0.5 to 3.0, and, more preferably, 0.75 to 1.5. When the ratio is within the above numerical range, assumed coarse powder can be efficiently separated. Therefore, the range is preferred.

(Pattern)

In the exemplary embodiment, the pattern which generates an upward-directed flow (upward flow) with respect to the vertical direction in the middle portion of a section of the microchannel is formed in the inner wall of the microchannel or in the partition wall.

For example, the sedimentation velocity of particles of a specific gravity of 1.2 and a particle size of 10 μm in water is about $1\times10^{-5}$ m/s from Stokes equation (20° C.). In the case of a highly concentrated particle dispersion, because of the effect of the exchange flow in which the fluid is moved so as to fill the volume where the particles have existed, the particles are actually sedimented at a velocity which is higher than the above-mentioned flow velocity. Therefore, the velocity of the upward flow must be set in accordance with the exchange flow. In a specific pattern, the velocity of the upward flow is changed in accordance with the flow velocity of the transporting liquid. When the flow velocity of the transporting liquid is adjusted, it is possible to adjust the velocity of the upward flow.

In the first exemplary embodiment, the pattern which generates the upward flow is formed in the partition wall. The pattern is formed as an opening pattern in which a plurality of V-like opening portions that are directed from the sidewalls of the microchannel toward the middle of the microchannel are continued along the flowing direction of the fluid. Referring to FIGS. 7A and 7B, the pattern in the first exemplary embodiment will be described.

Preferably, the angle $\theta_1$ of the middle portion of the V-like shapes is 80 to 140 deg., and, more preferably, 100 to 120 deg. When the angle is within the above numerical range, the upward flow can be efficiently produced. Therefore, the range is preferred.

Preferably, the ratio $l_1/d_1$ of the width $l_1$ of the V-like shapes in the flowing direction to the thickness $d_1$ of the partition wall is 0.5 to 2, and, more preferably, 0.75 to 1.5.

Preferably, the ratio $p_1/l_1$ of the pitch $p_1$ of the V-like shapes to the width $l_1$ of the V-like shapes in the flowing direction is 2 to 10, and, more preferably, 2 to 3. When the pitch is within the above numerical range, the upward flow can be efficiently produced. Therefore, the range is preferred.

These parameters are adequately set in accordance with the kind and flow velocity of the liquid, the kind and size of the particles, and the like.

(Particle Dispersion Supply Port)

The liquid transporting apparatus of the exemplary embodiment has the particle dispersion supply port through which the particle dispersion is supplied to the middle portion of the width direction of the first split channel. The size and shape of the particle dispersion supply port are requested to be suitable for supplying the particle dispersion, but are not particularly limited. Since the particle dispersion supply port is necessary to supply the particles to a place where an upward flow is generated, it is preferred that the position of the port is on the downstream side of the most upstream of the pattern which generates the upward flow.

Next, the particle dispersion will be described. The classifying apparatus and classifying method of the exemplary embodiment use sedimentation of particles, and hence the specific gravity of particles in the particle dispersion is larger than the specific gravities of the medium liquid which functions as a dispersion medium for the particle dispersion, and the transporting liquid.

Preferably, the volume-average particle size of the particles is 0.1 to 1,000 μm, more preferably, 0.1 to 500 μm, still more preferably, 0.1 to 200 μm, and, particularly preferably, 0.1 to 50 μm. When the volume-average particle size of the particles is within the above numerical range, clogging of the channel hardly occurs, the sedimentation velocity is adequate, and deposition on the bottom face of the channel and blocking of the channel are suppressed. Moreover, interaction with respect to the inner wall face of the channel hardly occurs so that adhesion hardly occurs.

The shape of the particles is not particularly limited. When the particles have a needle form and in particular the long axis thereof is larger than ¼ of the channel width, however, the possibility that clogging of the channel occurs becomes high. From this viewpoint, a ratio (the long axis length/the short axis length) of the long axis length of the particles to the short axis length thereof is preferably in the range from 1 to 50, and, more preferably, from 1 to 20. It is preferable that the channel width is appropriately selected in accordance with the particle size and the particle shape.

Examples of the kind of the particles are organic crystals or aggregates such as polymer particles or pigment, inorganic crystals or aggregates, metal particles, and metal compound particles such as a metal oxide, a metal sulfide, and a metal nitride.

Specific examples of the polymer particles are particles of polyvinyl butyral resin, polyvinyl acetal resin, polyarylate resin, polycarbonate resin, polyester resin, phenoxy resin, polyvinyl chloride resin, polyvinylidene chloride resin, polyvinyl acetate resin, polystyrene resin, acrylic resin, methacrylic resin, styrene/acrylic resin, styrene/methacrylic resin, polyacrylamide resin, polyamide resin, polyvinyl pyridine resin, cellulose-based resin, polyurethane resin, epoxy resin, silicone resin, polyvinyl alcohol resin, casein, vinyl chloride/ vinyl acetate copolymer, modified vinyl chloride/vinyl acetate copolymer, vinyl chloride/vinyl acetate/maleic anhydride copolymer, styrene/butadiene copolymer, vinylidene chloride/acrylonitrile copolymer, styrene/alkyd resin, and phenol/formaldehyde resin.

Examples of the metal or metal compound particles include particles of: carbon black; a metal such as zinc, aluminum, copper, iron, nickel, chromium, titanium, and the like, or alloys thereof; metal oxides such as $TiO_2$, $SnO_2$, $Sb_2O_3$, $In_2O_3$, ZnO, MgO, iron oxide, and the like, or any compound thereof; metal nitrides such as silicon nitride, and the like; and any combination thereof.

Various methods of producing these particles may be used. In many cases, particles are produced by synthesis in medium liquid, and then subjected to classification as they are. Sometimes, particles may be produced by mechanically pulverizing a bulk material and then dispersing the resulting particles in medium liquid, followed by classification. In this case, the material is often pulverized in the medium liquid, and the resulting particles are classified directly.

In the case where powder (particles) which is produced in a dry process is to be classified, it is necessary to previously disperse the powder in medium liquid. An example of a method of dispersing the dry powder in the medium liquid is a method using a sand mill, a colloid mill, an attritor, a ball mill, a Dyno mill, a high-pressure homogenizer, an ultrasonic disperser, a co-ball mill, a roll mill or the like. In this case, it is preferable to perform the process under conditions where primary particles are not pulverized by the dispersion process.

Preferably, the difference which is obtained by subtracting the specific gravity of the medium liquid from that of the particles is 0.01 to 20, more preferably, 0.05 to 11, and, still more preferably, 0.05 to 4. When the difference which is obtained by subtracting the specific gravity of the medium liquid from that of the particles is equal to or larger than 0.01, the particles are satisfactorily sedimented, and hence this is preferred. By contrast, when the difference is equal to smaller than 20, the particles are easily transported, and hence this is preferred.

As the medium liquid, any medium liquid is preferably used as far as, as described above, the difference obtained by subtracting the specific gravity of the medium liquid from that of the particles is 0.01 to 20. Examples of the medium liquid are water, aqueous media, organic solvent type media, and the like.

The water may be ion-exchange water, distilled water, electrolytic ion water, or the like. Specific examples of the organic solvent type media are methanol, ethanol, n-propanol, n-butanol, benzyl alcohol, methylcellosolve, ethylcellosolve, acetone, methyl ethyl ketone, cyclohexanone, methyl acetate, n-butyl acetate, dioxane, tetrahydrofuran, methylene chloride, chloroform, chlorobenzene, toluene, xylene, and the like, and mixtures of two or more thereof.

A preferred example of the medium liquid varies depending on the kind of the particles. As preferred examples of the medium liquid for each kind of the particles, the medium liquid to be combined with polymer particles (the specific gravity thereof is generally from about 1.05 to 1.6) are aqueous solvents, organic solvents such as alcohols, xylene, and the like, acidic or alkaline waters, and the like which do not dissolve the particles.

Further, preferred examples of the medium liquid to be combined with the metal or metal compound particles (the specific gravity thereof is generally from about 2 to 10) are water, organic solvents such as alcohols, xylene and the like, and oils which do not oxidize or reduce to react with the metal or the like.

More preferred examples of combinations of the particles and the medium liquid are a combination of polymer particles and an aqueous medium, and that of a metal or a metal compound and a low-viscosity oily medium. Among examples, the combination of polymer fine particles and an aqueous medium is particularly preferable.

Preferable examples of the combination of the particles and the medium liquid are a combination of styrene/acrylic resin particles and an aqueous medium, that of styrene/methacrylic resin particles and an aqueous medium, and that of polyester resin particles and an aqueous medium.

The content rate of the particles in the particle dispersion is preferably from 0.1 to 40 vol. %, and, more preferably, from 1 to 25 vol. %. When the content rate is within the above numerical range, efficient and accurate classification is enabled. Therefore, the range is preferred. Moreover, the particles are easily recovered, and clogging of the channel is suppressed. In the exemplary embodiment, even in the case where a particle dispersion which has a relatively high particle concentration, and which is conventionally difficult to be transported is used, particularly, deposition of the particles due to sedimentation is suppressed.

The volume-average particle size of the particles is a value which is measured by using Coulter Multisizer II model (manufactured by Beckman Coulter, Inc.) except when the particles have the particle size described below (5 μm or less). In this case, the volume-average particle size is measured by using an optimum aperture depending on the particle size level of the particles.

In the case where particles have a particle size of 5 μm or less, the volume-average particle size is measured by using a laser diffraction scattering particle size distribution measuring device (LA-920, manufactured by HORIBA, Ltd.).

The specific gravity of the particles is measured by using Ultrapycnometer 1000 manufactured by Yuasa Ionics Co., Ltd. by the gas phase displacement method (pycnometer method).

The specific gravity of the medium liquid is measured by using a specific gravity measuring kit AD-1653 manufactured by A & D Co., Ltd.

(Drain Port)

The liquid transporting apparatus of the exemplary embodiment has at least one drain port through which the fluid is discharged from the downstreams of the first and second split channels.

At least one drain port is formed in the first split channel, and a plurality of drain ports may be disposed depending on the kind of the particles to be classified.

At least one drain port is formed in the second split channel to recover coarse powder which has passed through the opening of the partition wall.

(Method of Producing Liquid Transporting Apparatus)

Preferably, the material used in the liquid transporting apparatus of the exemplary embodiment is a material which has high strength, which is anti-corrosive, and which enhances the fluidity of the particle dispersion. For example, a material which is usually used, such as a metal (iron, aluminum, stainless steel, titanium, and other various metals), a resin (a fluorine resin, an acrylic resin, or the like), ceramics, (silicon or the like), or glass (quartz or the like) can be used, and it is referable to adequately select the material in accordance with the the medium liquid to be transported. Alternatively, a film of $SiN_4$, $SiN_2$, $Al_2O_3$, or the like may be formed on the surface of the material configuring the classifying apparatus by performing the surface modifying process such as the plasma CVD method, thereby improving the corrosion resistance and the fluidity.

When the classifying apparatus is to be produced, a micro processing technology is applied. Examples of applicable micro processing technologies are LIGA (Roentgen-Lithographie Galvanik Abformung) technology using X-ray lithography, high-aspect ratio photolithography using EPON SU-8 (product name), a microdischarge processing method (μ-EDM (Micro Electro Discharge Machining)), a silicon high-aspect ratio processing method by Deep RIE (Reactive Ion Etching), a Hot Emboss processing method, a photoshaping method, a laser processing method, an ion beam processing method, and a mechanical micro-cutting processing method using a micro-tool made of a hard material such as diamond. These technologies may be used alone or as combination thereof. Preferable micro processing technologies are LIGA technology using X-ray lithography, high-aspect ratio photolithography using EPON SU-8, a microdischarge processing method (μ-EDM), and a mechanical micro-cutting processing method. In a microdevice (microchannel device), usually, a microchannel is often formed by applying a micro-discharging process on a member made of SUS (stainless steel). However, it is preferable that the processing is performed by a processing method corresponding to the used material.

A desirable method boding members is an accurate method which is not accompanied by destruction of the channel or the like due to modification or deformation of a material caused by high-temperature heating, and which can maintain the dimensional accuracy. Because of relationships with the materials used in production, it is preferable to select solid phase bonding (for example, pressure bonding and diffusion bonding) or liquid phase bonding (for example, welding, eutectic bonding, soldering, or adhesion). In the case where silicon is used as a material, examples of bonding are: silicon direct bonding in which silicon members are bonded to each other; fusion bonding in which glass members are bonded to each other; anode bonding in which a silicon member is bonded to a glass member; and diffusion bonding in which metal members are bonded to each other. In bonding of ceramics, a bonding technique other than mechanical sealing technique as in metals is necessary. A method is known in which a bonding agent called glass solder is printed onto an alumina member at a film thickness of about 80 μm by screen printing, and then a thermal process is performed at 440 to 500° C. without applying a pressure. As a novel technique, surface activation bonding, direct bonding using hydrogen bonding, bonding using HF (hydrogen fluoride) aqueous solution, and the like are known.

In production of the liquid transporting apparatus of the exemplary embodiment, it is possible to use a bonding technology. Usually, bonding technologies are roughly classified into solid phase bonding and liquid phase bonding. As a usual bonding method, pressure bonding and diffusion bonding are representative bonding methods in the solid phase bonding, and welding, eutectic bonding, soldering, adhesion, and the like are representative bonding methods in the liquid phase bonding.

In the bonding, furthermore, highly precise bonding method which does not involve destruction of a minute structure such as a channel by modification or deformation of a material due to high temperature heating, in which dimensional accuracy is maintained, and which is highly accurate is desirable. Examples of such a technology include silicon direct bonding, anode bonding, surface activation bonding, direct bonding using hydrogen bonding, bonding using HF aqueous solution, Au—Si eutectic bonding, void-free adhesion, and diffusion bonding.

In the method of producing the liquid transporting apparatus, a producing method in which pattern members (thin-film pattern members) are stacked is preferred. The thickness of the pattern members is not particularly limited, and, preferably, 5 to 500 μm, and, still more preferably, 10 to 300 μm.

Preferably, the classifying apparatus of the exemplary embodiment is a liquid transporting apparatus that is formed by stacking pattern members in which a predetermined two-dimensional pattern is formed. More preferably, the pattern members are stacked in a state where the faces of the pattern members are directly contacted and bonded together.

When a plurality of pattern members corresponding to the section shape in the horizontal or vertical direction of the liquid transporting apparatus are stacked, the liquid transporting apparatus can be simply formed, and hence this configuration is preferred.

An example of the method of producing the liquid transporting apparatus of the exemplary embodiment is a producing method including: (i) a step (donor substrate producing step) of forming a plurality of pattern members respectively corresponding to section shapes of the liquid transporting apparatus to be produced, on a first substrate; and (ii) a step (bonding step) of repeating bonding and separating processes on the first substrate on which the plurality of pattern members are formed, and a second substrate, whereby the plurality of pattern members on the first substrate are transferred to the second substrate. For example, the producing method disclosed in JP-A-2006-187684 may be referred. The method of producing the liquid transporting apparatus of the first exemplary embodiment will be described in further detail.

[Step of Producing Donor Substrate]

In the exemplary embodiment, a donor substrate is preferably produced by using the electroforming method. The donor substrate is a substrate in which a plurality of pattern members respectively corresponding to section shapes of the liquid classifying apparatus to be produced are formed on the first substrate. Preferably, the first substrate is formed by a metal, ceramics, or silicon, and a metal such as nickel may be preferably used.

First, a stainless steel substrate is prepared as the first substrate 500, a thick photoresist is applied onto the first substrate 500, an exposing process is performed by using photomasks respectively corresponding to the section shapes of the liquid classifying apparatus to be produced, and the photoresist is developed to form resist patterns in which the section shapes are respectively positive/negative inverted. Next, the substrate having the resist patterns is immersed in a plating bath, and, for example, nickel plating is grown on the surface of the metal substrate which is not covered by the photoresist. Preferably, the pattern members are formed by gold, cupper, or nickel by using the electroforming method.

Next, the resist patterns are removed away to form the pattern members which respectively correspond to the section shapes of the liquid classifying apparatus, on the first substrate.

[Bonding Step]

In the bonding step, bonding and separating processes on the first substrate (donor substrate) on which the plurality of pattern members are formed, and the second substrate (target substrate) are repeatedly performed, whereby the plurality of pattern members on the donor substrate are transferred to the target substrate. Preferably, the bonding process is performed by the surface activated bonding or the surface activation bonding.

FIGS. 8A to 8F are production step diagrams showing an exemplary embodiment of the method of producing the liquid transporting apparatus which can be preferably used in the exemplary embodiment.

Figure 8A:
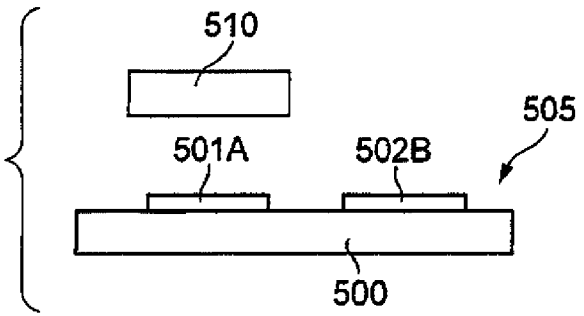
FIGS. 8A, 8B, 8C, 8D, 8E and 8F are production step diagrams showing an exemplary embodiment of a method of producing a liquid transporting apparatus which can be preferably used in the exemplary embodiment.

As shown in FIG. 8A, in the donor substrate 505, the plurality of pattern members (501) respectively corresponding to the section shapes of the liquid transporting apparatus to be produced are formed on the metal substrate 500 which is the first substrate. The donor substrate 505 is placed on a lower stage (not shown) in a vacuum chamber, and the target substrate 510 is placed on an upper stage (not shown) in the vacuum chamber. Then, the lower stage is moved relatively to the upper stage, so that the first pattern member 501A of the donor substrate 505 is positioned immediately below the target substrate 510. Next, the surfaces of the target substrate 510 and the first pattern member 501A are cleaned by being irradiated with an argon atomic beam.

Figure 8B:
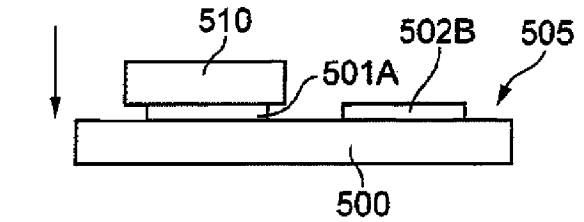

As shown in FIG. 8B, then, the upper stage is lowered to press the target substrate 510 and the donor substrate 505 by a predetermined stress (for example, 10 kgf/cm$^2$) for a predetermined time period (for example, five minutes), whereby the target substrate 510 and the first pattern member 501A are bonded together at room temperature (the surface activated bonding). In the exemplary embodiment, the pattern members are stacked in the sequence of the pattern members 501A, 501B, . . . .

Figure 8C:
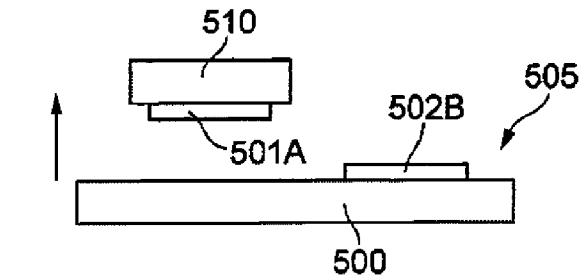

As shown in FIG. 8C, next, the upper stage is raised to separate the target substrate 510 from the donor substrate 505, and then the first pattern member 501A is peeled from the metal substrate (first substrate) 500, and transferred to the side of the target substrate 510. This is caused because the adhesive force between the first pattern member 501A and the target substrate 510 is larger than that between the first pattern member 501A and the metal substrate (first substrate) 500.

Figure 8D:
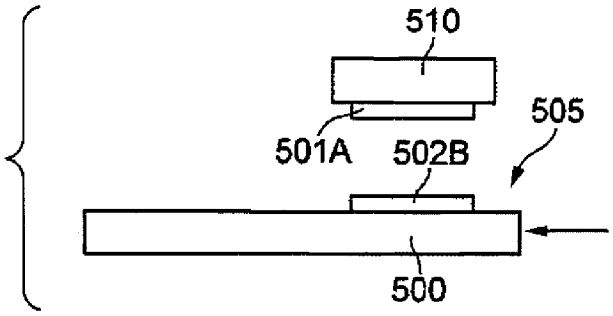

As shown in FIG. 8D, then, the lower stage is moved, so that the second pattern member 501B on the donor substrate 505 is positioned immediately below the target substrate 510. Then, the surface (the surface which is contacted with the metal substrate 500) of the first pattern member 501A which is transferred to the target substrate 510, and that of the second pattern member 501B are cleaned as described above.

Figure 8E:
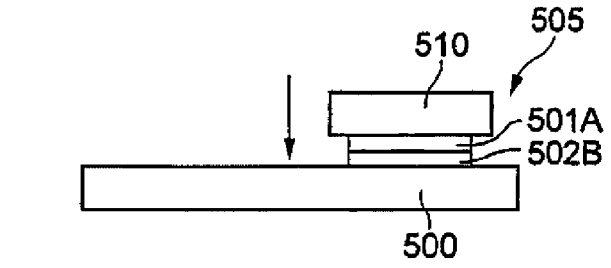
Figure 8F:
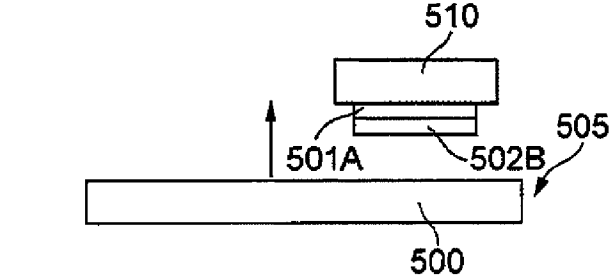

As shown in FIG. 8E, next, the upper stage is lowered to cause the first pattern member 501A and the second pattern member 501B to be bonded together, and, when the upper stage is then raised as shown in FIG. 8F, the second pattern member 501B is peeled from the metal substrate (first substrate) 500, and transferred to the side of the target substrate 510.

With respect to the other pattern members, the processes of positioning, bonding, and separating the donor substrate 505 and the target substrate 510 are similarly repeated, whereby the plurality of pattern members corresponding to the section shapes of the liquid transporting apparatus are transferred to the target substrate. The stack member transferred onto the target substrate 510 is detached from the upper stage, the target substrate 510 is removed away, and then the liquid transporting apparatus of the first exemplary embodiment is obtained.

Although, in the exemplary embodiment, the donor substrate is produced by using the electroforming method, the substrate may be is produced by using the semiconductor process. For example, a substrate configured by a Si wafer is prepared, a release layer made of polyimide is formed on the substrate by the spin coating method, an Al thin film which functions as a material constituting the liquid transporting apparatus is formed on the surface of the release layer by the sputtering method, and the Al thin film is patterned by the photolithography method, whereby the donor substrate can be produced.

Figure 9A:
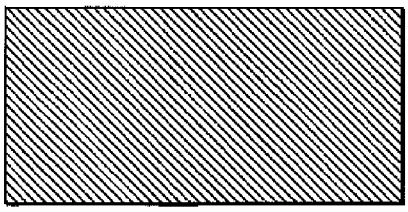
FIGS. 9A, 9B, 9C, 9D, 9E and 9F are conceptual views illustrating thin film pattern members for forming the liquid transporting apparatus of the first exemplary embodiment.
Figure 9D:
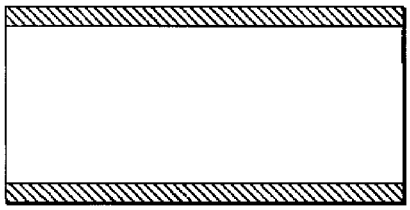
Figure 9B:
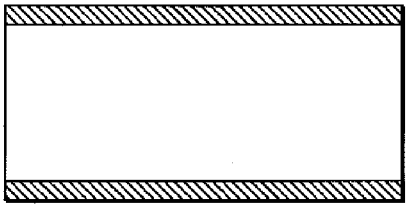
Figure 9E:
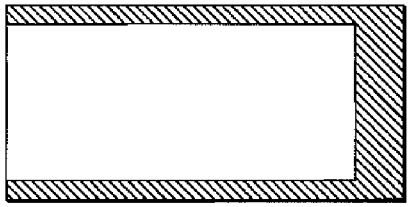
Figure 9C:
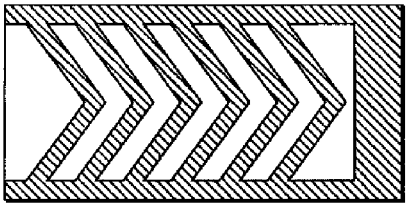
Figure 9F:
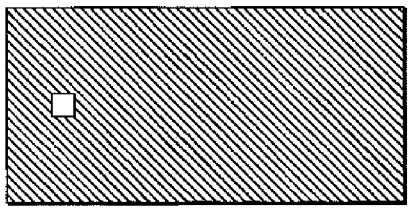

FIGS. 9A to 9F are conceptual views illustrating thin film pattern members for forming the liquid transporting apparatus of the first exemplary embodiment, and showing that the liquid transporting apparatus of the first exemplary embodiment is formed by stacking in which a total of six thin film pattern members of FIGS. 9A to 9F are combined with one another. The pattern members of FIGS. 9A to 9F are collectively formed on a stainless steel substrate (donor substrate) by electroforming of nickel. First, the pattern member of FIG. 9A is bonded and transferred onto the target substrate by the surface activated bonding technique. Next, the pattern members of FIGS. 9B and 9C are bonded and transferred onto the pattern member of FIG. 9A by a similar method. When the height of the second split channel is to be adjusted, the bonding transfer of the pattern member of FIG. 9B is performed a plurality of times. Successively, the pattern member of FIG. 9C is bonded and transferred, thereby forming the partition wall. Thereafter, the pattern member of FIG. 9D or 9E is combined, so that the height of the first split channel, and the positions (heights) and number of the drain ports can be adjusted. Finally, the pattern member of FIG. 9F is laminated to form the particle dispersion supply port. As a result of the above-described steps, the liquid transporting apparatus of the first exemplary embodiment is produced.

(Second Embodiment)

A liquid transporting apparatus of a second exemplary embodiment will be described.

The liquid transporting apparatus of the second exemplary embodiment is characterized in that the apparatus has: a microchannel; a transporting liquid supply port through which transporting liquid is supplied to the microchannel; a partition wall which is formed in a flowing direction of a fluid in the microchannel to vertically split the microchannel, and which has an opening; a first split channel which is located on the upper side of the partition wall; a second split channel which is located on the lower side of the partition wall; a particle dispersion supply port through which a particle dispersion is supplied to a middle portion of the width direction of the first split channel; and at least one drain port through which the fluid is discharged from the downstreams of the first and second split channels, and characterized in that a pattern which generates an upward-directed flow with respect to the vertical direction in a middle portion of a section of the microchannel is formed in an inner wall of the microchannel or in the partition wall, and the pattern is a pattern which is formed on both sidewalls of the first split channel, and in which a plurality of convex or concave portions are continued along the flowing direction of the fluid, the convex or concave portions being formed inclinedly with respect to the flowing direction of the fluid from the upper face of the first split channel toward the lower side.

Figure 10:
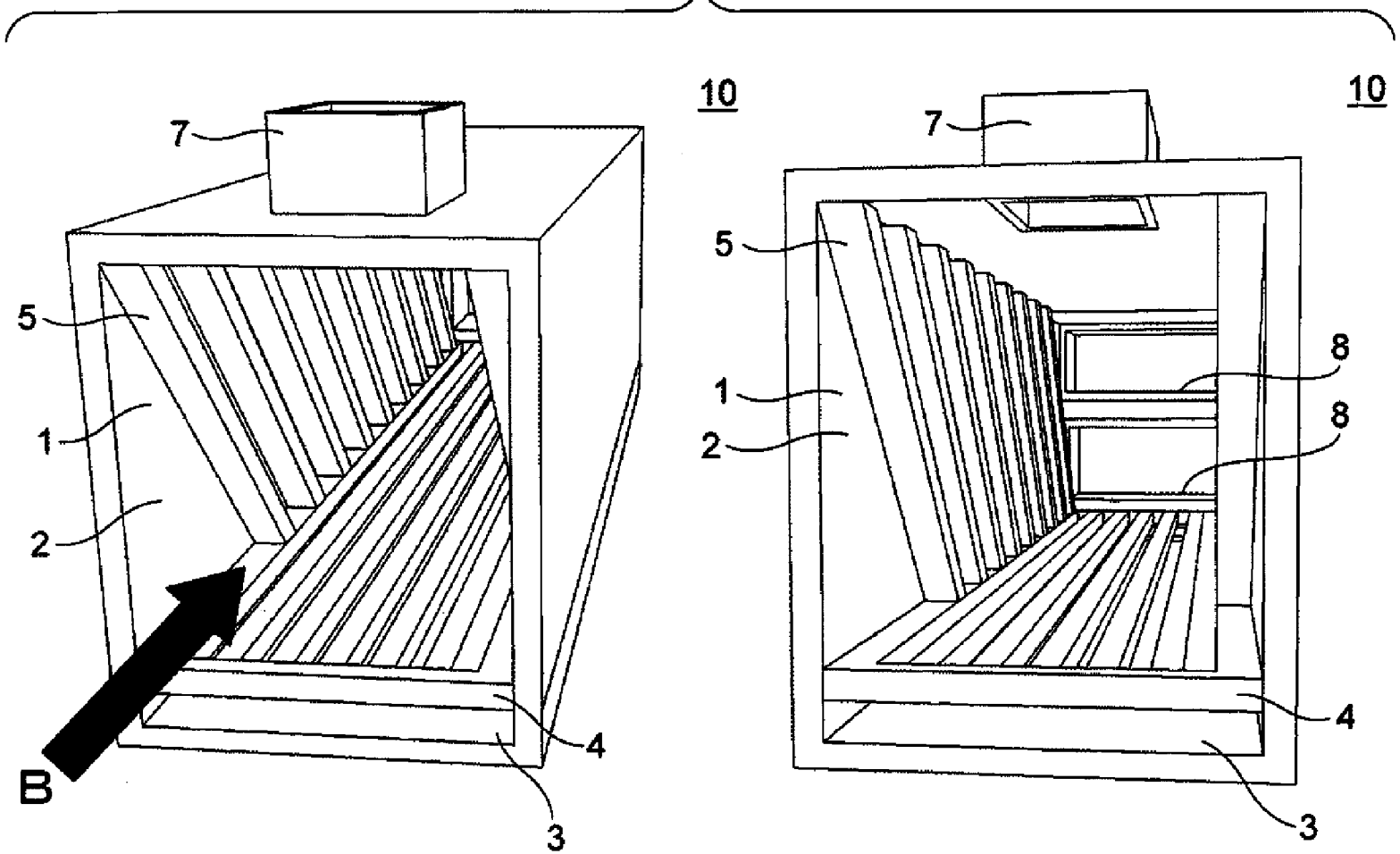
FIG. 10 is a perspective view of a liquid transporting apparatus of a second exemplary embodiment.

FIG. 10 is a perspective view of the liquid transporting apparatus of the second exemplary embodiment.

In the exemplary embodiment, the first split channel 2 and the second split channel 3 are partitioned from each other by the partition wall 4 having an opening in the liquid transportation direction.

Figure 11:
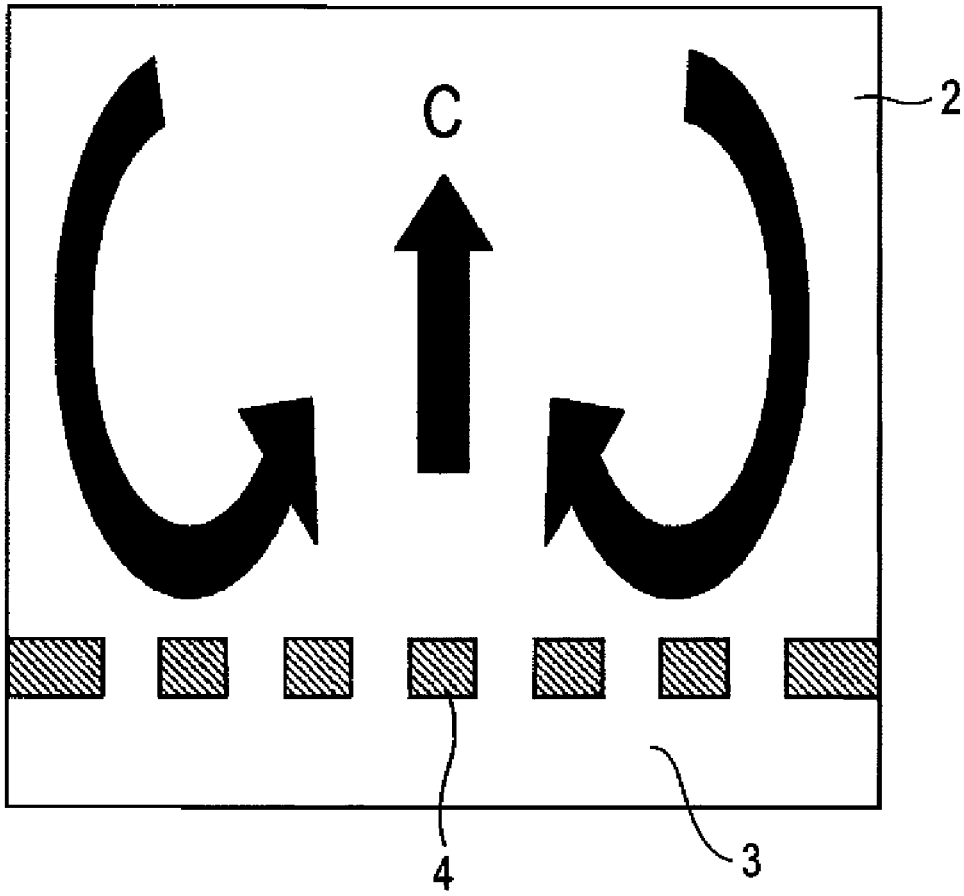
FIG. 11 is a diagram of an upward flow in the second exemplary embodiment.

FIG. 11 is a diagram of the generation of the downward and upward flows. The transporting liquid which is introduced into the first split channel, and which is in the vicinity of the sidewalls collides with the pattern formed on the both sidewalls of the first split channel. The pattern is a pattern in which a plurality of convex or concave portions that are formed inclinedly with respect to the flowing direction of the fluid from the upper face of the first split channel toward the lower side are continued along the flowing direction of the fluid. The direction of the transporting liquid which collides with the pattern is changed from the upper side toward the lower side because of the inclination of the pattern, and the transporting liquid is formed as a downward flow. The downward flow which collides with the partition wall to change the direction from the sidewall side collects to the middle portion, and has nowhere to go, so that the flow becomes as an upward flow C in the middle portion of the first split channel. The upward flow C and the downward flow are directed in the direction opposite to that of the exchange flow. When the liquid transporting conditions are adequately adjusted, therefore, the exchange flow and the upward flow can therefore offset each other.

The microchannel, the transporting liquid supply port, the split channels, the particle dispersion, the transporting liquid, the particle dispersion supply port, and the drain port in the second exemplary embodiment are identical with those in the first exemplary embodiment, and also their preferred ranges are identical with those in the first exemplary embodiment.

(Partition Wall)

Figure 12A:
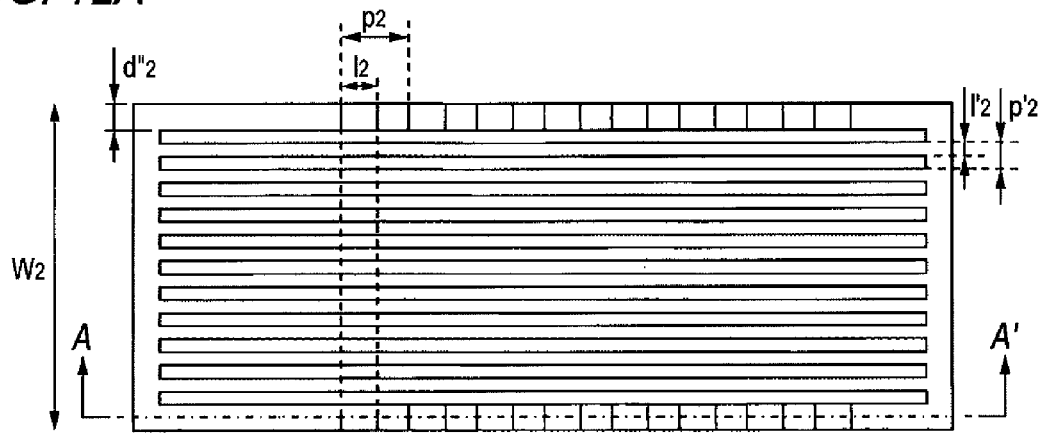
FIGS. 12A and 12B are diagrams illustrating shapes and the like of portions of the liquid transporting apparatus of the second exemplary embodiment.
Figure 12B:
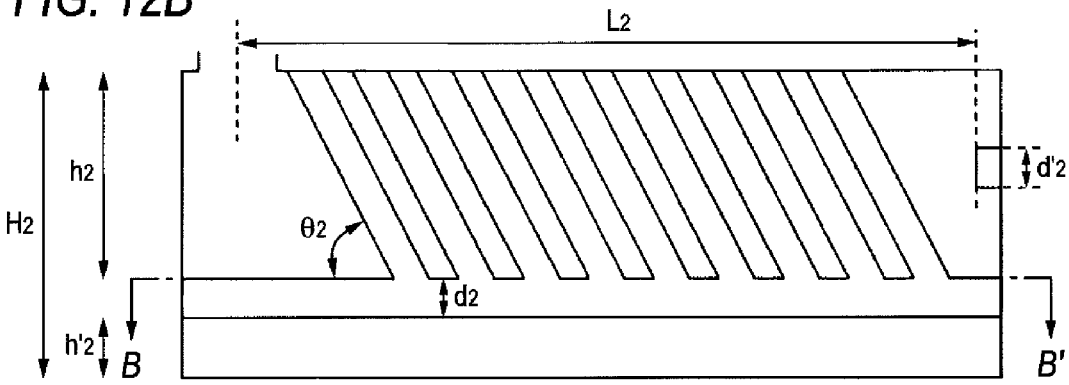

The partition wall in the second exemplary embodiment will be described with reference to FIGS. 12A and 12B. FIGS. 12A and 12B are diagrams illustrating shapes and the like of the portions of the liquid transporting apparatus of the second exemplary embodiment. FIG. 12A is a section view of the partition wall as viewed from the upper side and taken along B-B' of FIG. 12B, and FIG. 12B is a section view of the liquid transporting apparatus taken along A-A' of FIG. 12A.

The partition wall in the second exemplary embodiment is a partition wall which is formed in the fluid flowing direction in the microchannel to vertically split the microchannel, and which has an opening, but different from the partition wall in the first exemplary embodiment in that the pattern for producing the upward or downward flow is not formed.

The opening formed in the partition wall in the second exemplary embodiment is formed with the main object of separating coarse powder into the lower side of the partition wall. Therefore, the shape of the opening is not particularly limited, but, as shown FIG. 12A, the opening is preferably formed into a grid pattern having a stripe shape which extends in the fluid flowing direction, because the pattern does not disturb the fluid flow. The disposition position, thickness, and the like of the partition wall in the microchannel are identical with those of the partition wall in the first exemplary embodiment, and also their preferred ranges are identical.

Referring to FIG. 12A, the thickness $d_2$ of the partition wall is equal to the thickness $d_1$ of the partition wall in the first exemplary embodiment, and also its preferred range is identical.

Preferably, the ratio $l_2'/d_2$ of the width $l_2'$ of the grid formed in the partition wall to the thickness $d_2$ of the partition wall is 0.5 to 2, and, more preferably, 0.75 to 1.5. When the ratio is within the above numerical range, coarse powder can be efficiently separated. Therefore, the range is preferred.

Preferably, the ratio $p_2'/l_2'$ of the pitch $p_2'$ of the grid to the width $l_2'$ of the grid is 1 to 10, and, more preferably, 2 to 3. When the ratio is within the above numerical range, coarse powder can be efficiently separated.

(Pattern)

In the second exemplary embodiment, the pattern which generates the upward flow is is a pattern which is formed on both sidewalls of the first split channel, and in which the plurality of convex or concave portions that are formed inclinedly with respect to the flowing direction of the fluid from the upper face of the first split channel toward the lower side are continued along the flowing direction of the fluid. Referring to FIGS. 12A and 12B, the pattern in the second exemplary embodiment will be described.

Preferably, the angle $\theta_2$ formed by the convex (or concave) portions which are formed aslant, and the partition wall is equal to or larger than 10 deg. and less than 80 deg., more preferably, 20 to 70 deg., and, still more preferably, 30 to 60 deg. When the angle is within the above numerical range, the downward flow can be efficiently produced, and the pressure loss is small. Therefore, the range is preferred.

The thickness $d_2''$ of the convex (or concave) portions which are formed aslant is equal to the thickness $d_2$ of the partition wall, and also its preferred range is identical.

Preferably, the ratio $l_2/d_2''$ of the width $l_2$ of the convex (or concave) portions which are formed aslant, in the flowing direction to $d_2''$ is 0.5 to 2, and, more preferably, 0.75 to 1.5. When the ratio is within the above numerical range, the downward flow can be efficiently produced. Therefore, the range is preferred.

Preferably, the ratio $p_2/l_2$ of the pitch $p_2$ of the convex (or concave) portions which are formed aslant, to the width $1_2$ of the convex (or concave) portions which are formed aslant, in the flowing direction is 2 to 10, and, more preferably, 2 to 3. When the ratio is within the above numerical range, the downward flow can be efficiently produced, and the pressure loss is small. Therefore, the range is preferred.

Preferably, the pattern which is formed on both sidewalls of the first split channel is formed bilaterally symmetrically.

These parameters are adequately set in accordance with the kind and flow velocity of the liquid, the kind and size of the particles, and the like.

(Method of Producing Liquid Transporting Apparatus)

Figure 13A:
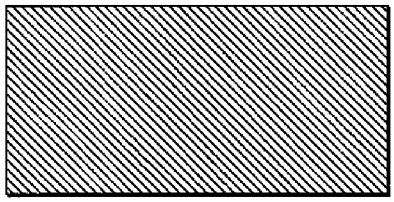
FIGS. 13A, 13B, 13C, 13D, 13E and 13F are conceptual views illustrating thin film pattern members for forming the liquid transporting apparatus of the second exemplary embodiment.
Figure 13D:
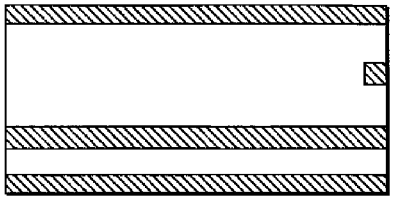
Figure 13B:
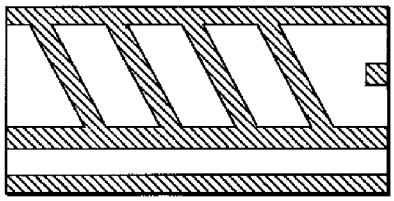
Figure 13E:
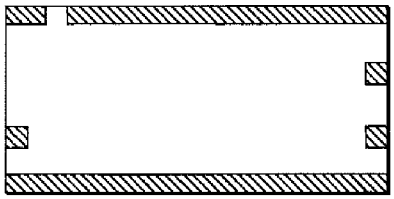

FIGS. 13A to 13F are conceptual views illustrating thin film pattern members for forming the liquid transporting apparatus of the second exemplary embodiment, and showing that the liquid transporting apparatus of the second exemplary embodiment is formed by a combination of a total of six thin film pattern members of FIGS. 13A to 13F. The pattern members of FIGS. 13A to 13F are collectively formed on a stainless steel substrate (donor substrate) by electroforming of nickel. First, the pattern member of FIG. 13A is bonded and transferred to the target substrate by the surface activated bonding. Next, the pattern member of FIG. 13B is bonded and transferred onto the pattern member of FIG. 13A by a similar method.

Figure 13C:
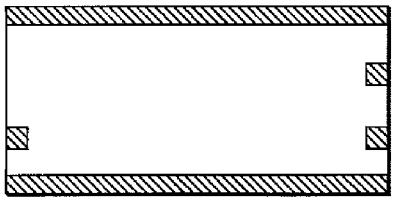
Figure 13F:
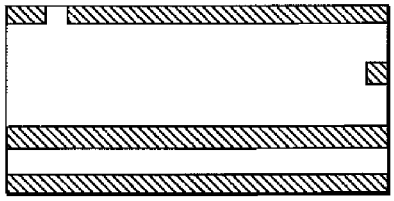

Subsequently, the pattern members of FIGS. 13C and 13D are alternately bonded and transferred, whereby the partition wall is formed. When the particle dispersion supply port is to be formed, the partition wall is formed by using the pattern members of FIGS. 13E and 13F in place of those of FIGS. 13C and 13D. The width and pitch of the opening of the partition wall, the width of the microchannel, and the like are adjusted by repeating a plurality of times the combination of the pattern members of FIGS. 13C and 13D or those of FIGS. 13E and 13F.

Thereafter, the pattern member of FIG. 13C is bonded and transferred, then the pattern member of FIG. 13B is bonded and transferred, and finally the pattern member of FIG. 13A is bonded and transferred, thereby completing the liquid transporting apparatus of the second exemplary embodiment.

(Third Embodiment)

A liquid transporting apparatus of a third exemplary embodiment will be described.

The liquid transporting apparatus of the third exemplary embodiment is characterized in that the apparatus has: a microchannel; a transporting liquid supply port through which transporting liquid is supplied to the microchannel; a partition wall which is formed in a flowing direction of a fluid in the microchannel to vertically split the microchannel, and which has an opening; a first split channel which is located on the upper side of the partition wall; a second split channel which is located on the lower side of the partition wall; a particle dispersion supply port through which a particle dispersion is supplied to a middle portion of the width direction of the first split channel; and at least one drain port through which the fluid is discharged from the downstreams of the first and second split channels, and characterized in that a pattern which generates an upward-directed flow with respect to the vertical direction in a middle portion of a section of the microchannel is formed in an inner wall of the microchannel or in the partition wall, and the pattern is a pattern which is formed in the inner wall of the upper face of the microchannel, and in which a plurality of V-like convex or concave portions that are directed from the middle of the inner wall of the upper face toward the sidewalls of the microchannel are continued along the flowing direction of the fluid.

Figure 14:
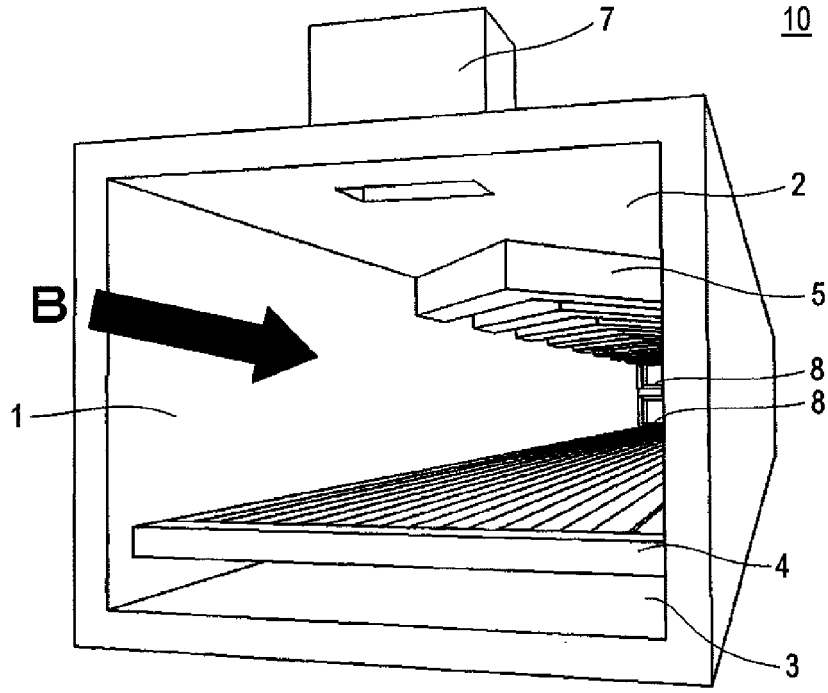
FIG. 14 is a perspective view of a liquid transporting apparatus of a third exemplary embodiment.

FIG. 14 is a perspective view of the liquid transporting apparatus of the third exemplary embodiment.

In the exemplary embodiment, the first split channel 2 and the second split channel 3 are partitioned from each other by the partition wall 4 which has an opening extending along the fluid transporting direction.

Figure 15:
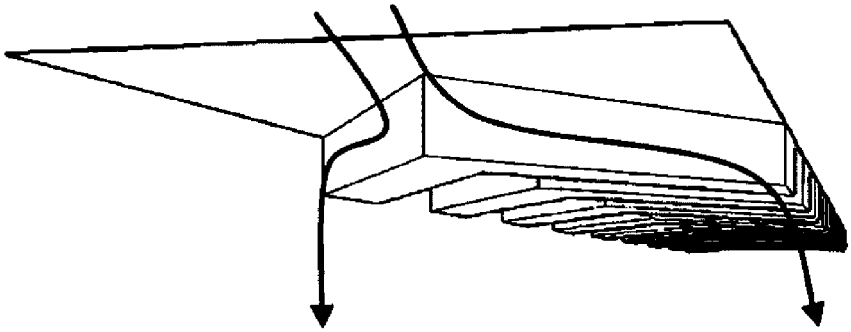
FIG. 15 is a conceptual diagram showing generation of an upward flow in the third exemplary embodiment.
Figure 16:
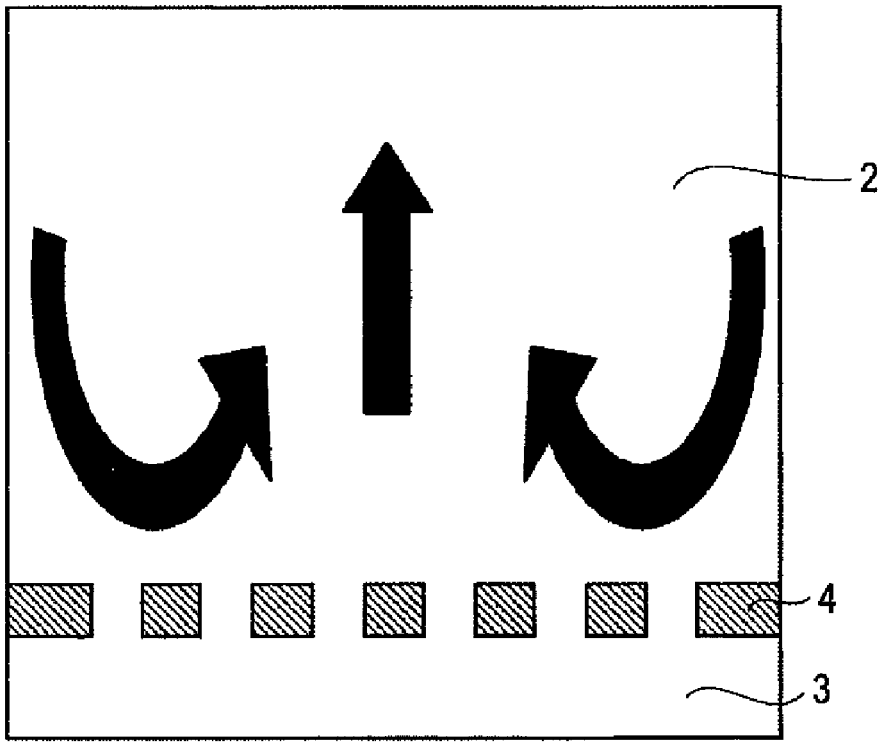
FIG. 16 is a diagram of downward and upward flows in the third exemplary embodiment.

FIG. 15 is a conceptual diagram showing generation of an upward flow in the third exemplary embodiment. The transporting liquid which is introduced into the first split channel, and which is in the vicinity of the sidewalls collides with the V-like pattern which is formed on the both sidewalls of the first split channel, and which is directed from the upper face of the first split channel toward the lower side along the flowing direction of the fluid, and the direction of the transporting liquid is changed from the middle toward the sidewall sides because of the inclination of the pattern. The fluid which collides with the partition wall has nowhere to go, and is formed into downward flows in the vicinities of the sidewalls. As shown in FIG. 16, after colliding with the partition wall, the fluid causes an upward flow C in the middle portion of the first split channel. The upward and downward flows are directed in the direction entirely opposite to that of the exchange flow. When the structure and the flow conditions are adequately designed, therefore, the exchange flow and the upward flow can offset each other.

The microchannel, the transporting liquid supply port, the partition wall, the split channels, the particle dispersion, the transporting liquid, the particle dispersion supply port, and the drain port in the third exemplary embodiment are identical with those in the second exemplary embodiment, and also their preferred ranges are identical with those in the second exemplary embodiment.

(Pattern)

Figure 17A:
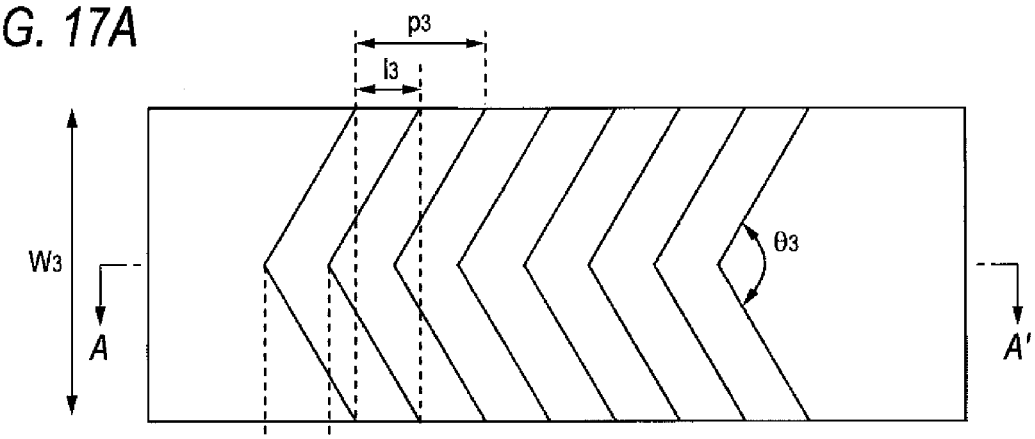
FIGS. 17A and 17B are diagrams illustrating shapes and the like of portions of the liquid transporting apparatus of the third exemplary embodiment.
Figure 17B:
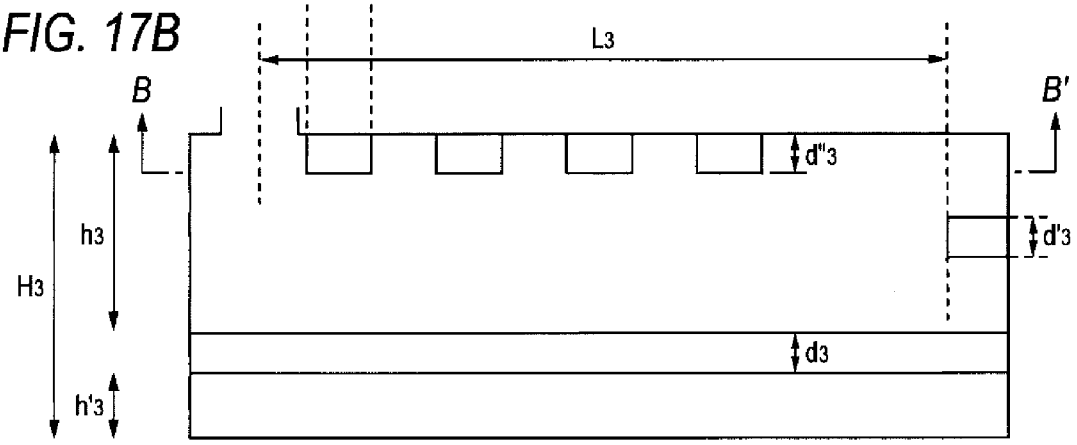

In the third exemplary embodiment, the pattern which generates the downward flow and the upward flow is a pattern which is formed in the inner wall of the upper face of the microchannel, and in which a plurality of V-like convex or concave portions that are directed from the middle of the inner wall of the upper face toward the sidewalls of the microchannel are continued along the flowing direction of the fluid. Referring to FIGS. 17A and 17B, the pattern in the third exemplary embodiment will be described.

Preferably, the angle $\theta_3$ of the middle portion of the V-like shape is 80 to 140 deg., and, more preferably, 100 to 120 deg. When the angle is within the above numerical range, the downward flow can be efficiently produced. Therefore, the range is preferred.

Preferably, the ratio $l_3/d_3''$ of the width $l_3$ of the V-like shape in the flowing direction to the thickness $d_3''$ of the pattern in the vertical direction is 0.5 to 2, and, more preferably, 0.75 to 1.5.

Preferably, the ratio $p_3/l_3$ of the pitch $p_3$ of the V-like shape to the width $l_3$ of the V-like shape in the flowing direction is 2 to 10, and, more preferably, 2 to 3. When the ratio is within the above numerical range, the upward flow can be efficiently produced. Therefore, the range is preferred.

These parameters are adequately set in accordance with the kind and flow velocity of the liquid, the kind and size of the particles, and the like.

Preferably, the ratio $d_3''/h_3$ of the thickness $d_3''$ of the pattern in the vertical direction to the height $h_3$ of the first split channel is 0.1 to 0.5, and, more preferably, 0.2 to 0.3. When the ratio is within the above numerical range, the upward flow can be efficiently produced. Therefore, the range is preferred.

(Method of Producing Liquid Transporting Apparatus)

Figure 18A:
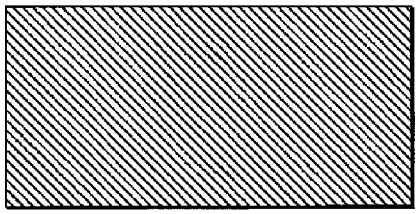
FIGS. 18A, 18B, 18C, 18D, 18E and 18F are conceptual views illustrating thin film pattern members for forming the liquid transporting apparatus of the third exemplary embodiment.
Figure 18D:
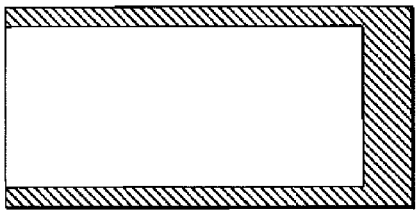
Figure 18B:
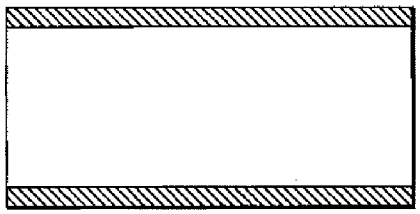
Figure 18E:
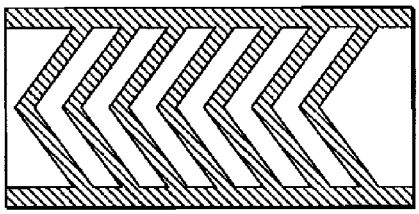
Figure 18C:
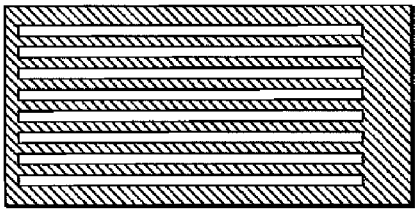
Figure 18F:
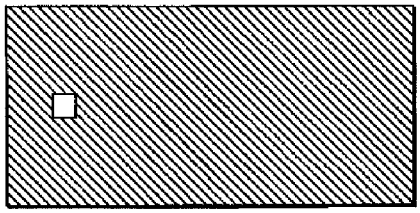

FIGS. 18A to 18F are conceptual views illustrating thin film pattern members for forming the liquid transporting apparatus of the third exemplary embodiment, and showing that the liquid transporting apparatus of the third exemplary embodiment is formed by a combination of a total of six thin film pattern members of FIGS. 18A to 18F. The pattern members of FIGS. 18A to 18F are collectively formed on a stainless steel substrate (donor substrate) by electroforming of nickel. First, the pattern member of FIG. 18A is bonded and transferred to the target substrate by the surface activated bonding technique. Next, the pattern member of FIG. 18B is bonded and transferred onto the pattern member of FIG. 18A by a similar method, and thereafter a partition wall of FIG. 18C is bonded and transferred. When the height of the second split channel is to be adjusted, the bond-transferring of the pattern member of FIG. 18B is repeated a plurality of times. Thereafter, the pattern member of FIG. 18B or 18D is combinedly bonded and transferred a plurality of times, so that the height of the first split channel, and the positions (heights) and number of the drain ports can be adjusted. Finally, the pattern members of FIGS. 18E and 18F are bonded and transferred to form the particle dispersion supply port. As a result of the above-described steps, the liquid transporting apparatus of the third exemplary embodiment is produced.

In the above, the patterns for generating an upward flow in the first to third exemplary embodiments have been described. Also liquid transporting apparatuses in which the exemplary embodiments are adequately combined with each other, such as the case where a partition wall in which the pattern in the first exemplary embodiment is formed is applied to the second or third exemplary embodiment are included in the liquid transporting apparatus of the exemplary embodiment.

II. Classifying Apparatus and Classifying Method

Next, a classifying apparatus and classifying method which use the liquid transporting apparatus of the exemplary embodiment will be described.

The classifying apparatus of the exemplary embodiment is characterized in that the apparatus includes the liquid transporting apparatus of the exemplary embodiment.

The classifying method of the exemplary embodiment is characterized in that the method includes: a supplying step of transporting a particle dispersion to the particle dispersion supply port of the classifying apparatus of the exemplary embodiment; and a classifying step of classifying particles in the microchannel.

In the classifying method in which the liquid transporting method of the exemplary embodiment is used, the sedimentation velocity of the particles in the liquid transporting channel is close to that of the particles based on Stokes equation, and particle classification using the sedimentation velocity is performed in a manner similar to particle classification depending on the theoretical sedimentation velocity difference. Specifically, the flow velocity is selected so that an upward flow of a degree at which the exchange flow is canceled is generated, whereby particle classification using the sedimentation velocity difference between particles of different sizes can be performed.

Figure 19:
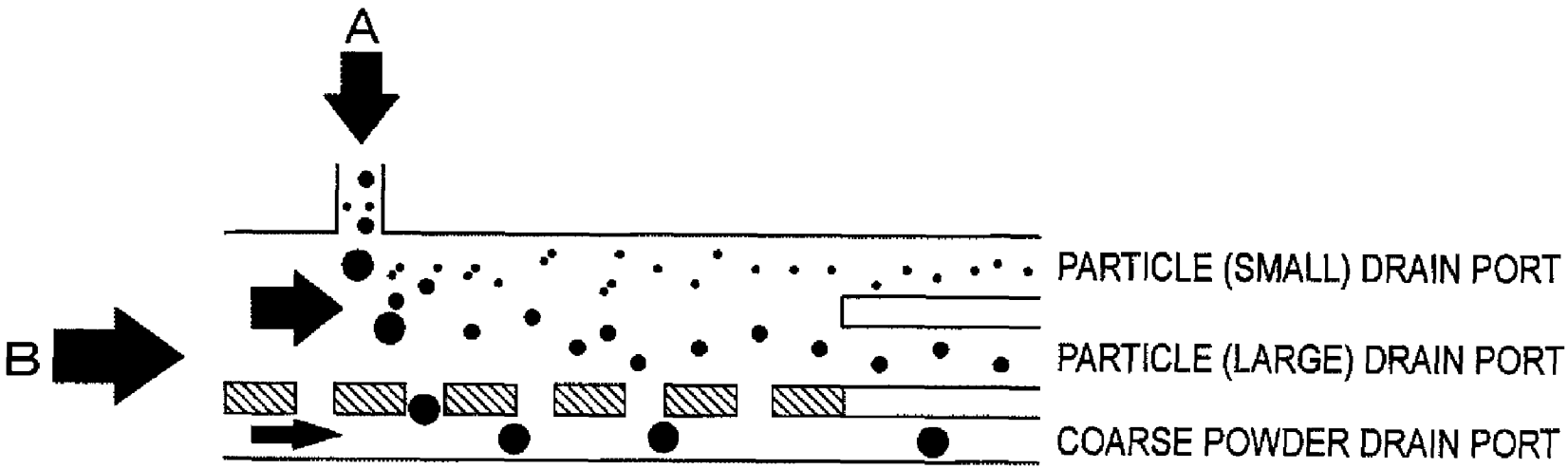
FIG. 19 is a conceptual view illustrating a classifying apparatus and method of the exemplary embodiment.

FIG. 19 is a conceptual view illustrating the case where a transporting liquid and a particle dispersion are transported of the classifying apparatus of the exemplary embodiment. When the transporting liquid is transported through the microchannel, an upward-directed flow is generated with respect to the vertical direction in the middle portion of a section of the microchannel, by the pattern formed in the inner wall of the microchannel or in the partition wall.

On the other hand, a exchange flow is generated by the particle dispersion supplied from the particle dispersion supply port through which the particle dispersion is supplied to the middle portion of the width direction of the first split channel. The flow which is generated by the pattern, and the exchange flow are opposite in direction to each other, and hence cancel each other, and the supplied particles are sedimented in accordance with Stokes equation. Among particles contained in the particle dispersion, particles having a small particle size are recovered through the the upper drain port which is formed in the downstream of the first split channel. Particle which are larger in particle size than those which are recovered through the second drain port are further sedimented, and recovered through the the lower drain port which is formed in the downstream of the first split channel. Among particles contained in the dispersion, coarse powder having a large particle size is passed through the opening formed in the partition wall, sedimented to the second split channel, and then discharged from the drain port which is formed the downstream second split channel.

EXAMPLES

Hereinafter, the exemplary embodiment will be described in detail by showing examples and a comparative example. However, the exemplary embodiment is in no way limited to the following examples.

Example 1

The classifying apparatus of the first exemplary embodiment is produced. The dimensions of the classifying apparatus shown in FIGS. 7A and 7B are as follows.

Width $W_1$ of microchannel: 1 mm
Length $L_1$ of microchannel: 25 mm
Height $h_1$ of first split channel: 1 mm
Thickness $d_1$ of partition wall: 0.25 mm
Height $h_1'$ of second split channel: 0.25 mm
Angle $\theta_1$ of tip end of V-like pattern: 110 deg.
Width $l_1$ of V-like pattern in flowing direction: 0.25 mm
Pitch $p_1$ of V-like pattern: 0.75 mm.

A partition which separates the upper and lower drain ports formed in the downstream of the first split channel from each other is disposed in a substantially intermediate position of the end of the first split channel. The thickness $d_1'$ of the partition is 0.25 mm.

(Check of Generation Upward Flow)

A resin particle dispersion containing 10 wt. % of color beads of a specific gravity of 1.0 is transported from the particle dispersion supply port, and it is observed whether an upward flow is generated in the first split channel or not. Evaluation results are listed in Table 1.

(Evaluation of Classification)

Monodisperse polyester true spherical particles (density: 1,200 kg/m$^3$) having the following average particle sizes are dispersed in pure water to prepare a particle dispersion (particle dispersion (1)) (containing a trace amount of a surfactant) having a concentration of 10 wt. &.

Average particle size (small particle size) 6 μm: 5 parts
Average particle size (large particle size) 15 μm: 5 parts
Water: 90 parts The particle dispersion (1) and the transporting liquid (water) are transported by using a syringe pump. The particle dispersion (1) is transported from the particle dispersion supply port at a transportation velocity of 2 to 20 ml/h, and the transporting liquid is transported from the transporting liquid supply port at a transportation velocity of 10 to 100 ml/h.

The recovery liquid from the upper drain port of the first split channel is called Recovery liquid (1), that from the lower drain port of the first split channel is called Recovery liquid (2), and that from the upper drain port of the second split channel is called Recovery liquid (3).

The number-average particle size and number-average particle size distribution index of particles contained in each recovery liquid are evaluated.

The number-average particle size and number-average particle size distribution index of the particles are measured by using Coulter Multisizer II model (manufactured by Beckman Coulter, Inc.). The ratios of large and small monodisperse polyester particles which are divided on the basis of the particle size distribution are counted at each outlet. Evaluation results are listed in Table 1.

Example 2

The classifying apparatus of the second exemplary embodiment is produced. The dimensions of the classifying apparatus shown in FIGS. 12A and 12B are as follows.

Width $W_2$ of microchannel: 1 mm
Length $L_2$ of microchannel: 20 mm
Height $h_2$ of first split channel: 1 mm
Thickness $d_2$ of partition wall: 0.1 mm
Width $l_2'$ of grid formed in partition wall: 0.1 mm
Pitch $p_2'$ of grid: 0.2 mm
Height $h_2'$ of second split channel: 0.2 mm
Angle $\theta_2$ of formed aslant convex portion: 60 deg.
Width $l_2$ of formed aslant convex portion in flowing direction: 0.1 mm
Pitch $p_2$ of formed aslant convex portion: 0.3 mm
Thickness $d_2''$ of formed aslant convex portion: 0.1 mm A partition which separates the upper and lower drain ports formed in the downstream of the first split channel from each other is disposed in a substantially intermediate position of the end of the first split channel. The thickness $d_2'$ of the partition is 0.1 mm. In the same manner as Example 1, the generation of an upward flow is checked, and the classification is evaluated. The results are listed in Table 1.

Example 3

The classifying apparatus of the third exemplary embodiment is produced. The dimensions of the classifying apparatus shown in FIGS. 17A and 17B are as follows.

Width $W_3$ of microchannel: 1 mm
Length $L_3$ of microchannel: 30 mm
Height $h_3$ of first split channel: 1 mm
Thickness $d_3$ of partition wall: 0.1 mm Height $h_3'$ of second split channel: 0.3 mm Angle $\theta_3$ of tip end of V-like pattern: 110 deg.

Width $l_3$ of V-like pattern in flowing direction: 0.25 mm

Pitch $p_3$ of V-like pattern: 0.75 mm.

Thickness $d_3''$ of V-like pattern: 0.1 mm

A partition which separates the upper and lower drain ports formed in the downstream of the first split channel from each other is disposed in a substantially intermediate position of the end of the first split channel. The thickness $d_3'$ of the partition is 0.1 mm.

In the same manner as Example 1, the generation of an upward flow is checked, and the classification is evaluated. The results are listed in Table 1.

Comparative Example

A classifying apparatus is produced by using the partition wall used in Example 2 in place of the partition wall of the classifying apparatus used in Example 1. In the same manner as Example 1, the generation of an upward flow is checked, and the classification is evaluated. The results are listed in Table 1.

TABLE 1

| | | Example/Comparative example | | | |
|---|---|---|---|---|---|
| | | Ex. 1 | Ex. 2 | Ex. 3 | Comp. example |
| Generation of upward flow | | Exist | Exist | Exist | Not exist |
| Ratio % of 6 μm fine particles | Recovery liquid (1) | 98 | 98 | 99 | 80 |
| | Recovery liquid (2) | 2 | 2 | 1 | 15 |
| | Recovery liquid (3) | 0 | 0 | 0 | 5 |
| Ratio % of 15 μm fine particles | Recovery liquid (1) | 2 | 2 | 1 | 10 |
| | Recovery liquid (2) | 98 | 98 | 99 | 80 |
| | Recovery liquid (3) | 0 | 0 | 0 | 10 |

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A liquid transporting apparatus, wherein the apparatus comprises:

a microchannel;

a transporting liquid supply port through which transporting liquid is supplied to the microchannel;

a partition wall that is provided in a flowing direction of a fluid in the microchannel to vertically split the microchannel, and that has an opening;

a first split channel that is provided on an upper side of the partition wall;

a second split channel that is provided on a lower side of the partition wall;

a particle dispersion supply port through which a particle dispersion is supplied to a middle portion of a width direction of the first split channel; and at least one drain port through which the fluid is discharged from downstreams of the first and second split channels, and a pattern comprising openings that generates an upward-directed flow with respect to a vertical direction in a middle portion of a section of the microchannel is formed in an inner wall of the microchannel or in the partition wall.

2. The liquid transporting apparatus according to claim 1, wherein the pattern is a pattern which is formed in the partition wall, and an opening pattern in which a plurality of V-like opening portions that are directed from sidewalls of the microchannel toward the middle of the microchannel are continued along the flowing direction of the fluid.

3. The liquid transporting apparatus according to claim 1, wherein the pattern is a pattern which is formed on both sidewalls of the first split channel, and in which a plurality of convex or concave portions are continued along the flowing direction of the fluid, the convex or concave portions being formed inclinedly with respect to the flowing direction of the fluid from an upper face of the first split channel toward the lower side.

4. The liquid transporting apparatus according to claim 1, wherein the pattern is a pattern which is formed in the inner wall of an upper face of the microchannel, and in which a plurality of V-like convex or concave portions that are directed from the middle of the inner wall of the upper face toward the sidewalls of the microchannel are continued along the flowing direction of the fluid.

5. The liquid transporting apparatus according to claim 1, wherein a width of the microchannel is 0.01 to 30 mm.

6. The liquid transporting apparatus according to claim 1, wherein a channel length extending from the particle dispersion supply port to the drain port is from 5 to 200 mm.

7. The liquid transporting apparatus according to claim 1, wherein the transporting liquid supply port supplies the transporting liquid to a whole of the microchannel.

8. The liquid transporting apparatus according to claim 1, wherein, when a thickness of the partition wall is indicated by $d_1$ and a height of the first split channel is indicated by $h_1$, a ratio $d_1/h_1$ is 0.1 to 0.5.

9. The liquid transporting apparatus according to claim 1, wherein widths of the first and second split channels are equal to a width of the microchannel.

10. The liquid transporting apparatus according to claim 1, wherein, when a height of the first split channel is indicated by $h_1$ and a width of the microchannel is indicated by $W_1$, a ratio $h_1/W_1$ is 0.1 to 10.

11. The liquid transporting apparatus according to claim 1, wherein, when a height of the second split channel is indicated by $h_1'$ and a thickness of the partition wall is indicated by $d_1$, a ratio $h_1'/d_1$ is 0.5 to 3.0.

12. The liquid transporting apparatus according to claim 2, wherein an angle of a middle portion of the V-like shape is 80 to 140 deg.

13. The liquid transporting apparatus according to claim 2, wherein a ratio $l_1/d_1$ of a width $l_1$ of the V-like shape in the flowing direction to a thickness $d_1$ of the partition wall is 0.5 to 2.

14. The liquid transporting apparatus according to claim 2, wherein a ratio $p_1/l_1$ of a pitch $p_1$ of the V-like shape to a width $l_1$ of the V-like shape in the flowing direction is 2 to 10.

15. The liquid transporting apparatus according to claim 3, wherein a ratio $l_2'/d_2$ of a width $l_2'$ of a grid formed in the partition wall to a thickness $d_2$ of the partition wall is 0.5 to 2.

16. The liquid transporting apparatus according to claim 3, wherein a ratio $p_2'/l_2'$ of a pitch $p_2'$ of a grid formed in the partition wall to a width $l_2'$ of the grid is 1 to 10.

17. The liquid transporting apparatus according to claim 3, wherein an angle $\theta_2$ formed by the convex or concave portions which are formed aslant, and the partition wall is equal to or larger than 10 deg. and less than 80 deg.

18. The liquid transporting apparatus according to claim 3, wherein a ratio $l_2/d_2''$ of a width $l_2$ of the convex or concave portions which are formed aslant, in the flowing direction to a thickness $d_2''$ of the convex or concave portions is 0.5 to 2.

19. The liquid transporting apparatus according to claim 3, wherein a ratio $p_2/l_2$ of a pitch $p_2$ of the convex or concave portions which are formed aslant, to a width $l_2$ of the convex or concave portions which are formed aslant, in the flowing direction is 2 to 10.

20. The liquid transporting apparatus according to claim 4, wherein an angle $\theta_3$ of a middle portion of the V-like shape is 80 to 140 deg.

21. The liquid transporting apparatus according to claim 4, wherein a ratio $l_3/d_3''$ of a width $l_3$ of the V-like shape in the flowing direction to a thickness $d_3''$ of the pattern in the vertical direction is 0.5 to 2.

22. The liquid transporting apparatus according to claim 4, wherein a ratio $p_3/l_3$ of a pitch $p_3$ of the V-like shape to a width $l_3$ of the V-like shape in the flowing direction is 2 to 10.

23. The liquid transporting apparatus according to claim 4, wherein a ratio $d_3''/h_3$ of a thickness $d_3''$ of the pattern in the vertical direction to a height $h_3$ of the first split channel is 0.1 to 0.5.

24. A classifying apparatus comprising the liquid transporting apparatus according to claim 1.

* * * * *